US006644643B2

(12) United States Patent
Nonaka et al.

(10) Patent No.: US 6,644,643 B2
(45) Date of Patent: Nov. 11, 2003

(54) SHEET PROCESSING APPARATUS AND IMAGE FORMING APPARATUS

(75) Inventors: Masato Nonaka, Abiko (JP); Satoshi Iwama, Yamanashi-ken (JP)

(73) Assignee: Nisca Corporation, Yamanashi (JP)

( * ) Notice: Subject to any disclaimer, the term of this patent is extended or adjusted under 35 U.S.C. 154(b) by 114 days.

(21) Appl. No.: 10/058,055

(22) Filed: Jan. 29, 2002

(65) Prior Publication Data

US 2002/0101021 A1 Aug. 1, 2002

(30) Foreign Application Priority Data

Jan. 30, 2001 (JP) ..... 2001-021663

(51) Int. Cl.[7] ..... B65H 37/04

(52) U.S. Cl. ..... 270/58.08; 399/410; 227/100; 227/150; 227/154

(58) Field of Search ..... 270/58.08; 399/410; 227/110, 111, 99, 100, 150, 154, 155

(56) References Cited

U.S. PATENT DOCUMENTS 4,988,030 A * 1/1991 Muramatu et al. ..... 227/27
5,114,130 A * 5/1992 Hamanaka et al. ..... 270/58.11
5,799,935 A * 9/1998 Yamanushi et al. ..... 270/58.08
5,931,460 A * 8/1999 Kadowaki et al. ..... 271/220
6,171,225 B1 * 1/2001 Nonoyama et al. ..... 493/16
6,223,965 B1 * 5/2001 Nakatsuka ..... 227/111
6,290,220 B1 * 9/2001 Takehara et al. ..... 270/58.12
6,568,669 B2 * 5/2003 Hosaka ..... 270/58.12

FOREIGN PATENT DOCUMENTS

JP 7-157180 A * 6/1995
JP 7-187479 A * 7/1995
JP 8-192951 A * 7/1996
JP 10-218474 A * 8/1998
JP 2000-63031 A * 2/2000
JP 2002-128380 A * 5/2002

* cited by examiner

*Primary Examiner*—Patrick Mackey
(74) *Attorney, Agent, or Firm*—Kanesaka & Takeuchi

(57) ABSTRACT

A sheet processing apparatus for processing a sheet bundle includes a stitching unit having a head portion for driving staples into the sheet bundle and an anvil portion for receiving and bending the staples driven by the head portion, a feeding device for feeding the sheet bundle to a stitching position between the head portion and the anvil portion, a transport device for transporting the stitching unit to a position perpendicular to a sheet bundle feeding direction, a guide member for guiding the sheet bundle to the stitching position, and a supplement guide member. The supplement guide member retracts to a position that does not hinder the movement of the stitching unit when the stitching unit moves, and guides the sheet bundle to the guide member without a leading edge of the sheet bundle touching the upstream edge of the guide member.

6 Claims, 20 Drawing Sheets

SHEET PROCESSING APPARATUS AND IMAGE FORMING APPARATUS

BACKGROUND OF THE INVENTION AND RELATED ART STATEMENT

The present invention relates to a sheet processing apparatus and an image reading apparatus, in particular it relates to an apparatus for performing a sheet bundle binding process.

Conventionally, an image forming apparatus such as a copier, a printer, a facsimile machine and other devices that combine them have a sheet processing apparatus that stacks a bundle of sheets discharged from the image forming apparatus and staples (binding process) the bundle.

Some of such apparatuses are provided with a stitching unit comprising a head to drive staples and an anvil to receive and bend the staples to bind a bundle of sheets substantially in a center area thereof.

An example of such a sheet processing apparatus, as disclosed in Japanese Patent Publication 07-157180, has a partial guide attached directly to a head and an anvil to guide a bundle to pass between them.

Nonetheless, in a conventional sheet processing apparatus, the guide is extended traversing a moving direction of a bundle when a bundle passes through a transport path between the head and the anvil. The guide also extends parallel to the bundle surface opposite to the head and anvil, i.e. a width direction of the bundle. In this case, it is not possible to guide and support the bundle completely across its width direction. Therefore, an edge of the bundle in the width direction tends to droop down or get caught on other internal parts upon transporting or stitching. As a result, an accurate positioning of the bundle is obstructed, causing undesirable stitching.

If a guide is attached substantially across an entire region in a width direction of the bundle, it is possible to guide and support the bundle throughout the entire width direction. But a leading edge of the bundle is easy to get caught in a gap between the head, the anvil and the guide, causing inaccurate positioning of the bundle and improper binding of the bundle.

An object of the present invention, in view of the problems of the current technology, is to provide a sheet processing apparatus and an image reading apparatus that securely transports and properly stitches a bundle.

Further objects and advantages of the invention will be apparent from the following description of the invention.

SUMMARY OF THE INVENTION

The present invention provides a sheet processing apparatus comprising a stitching unit having a head to drive staples into a bundle of sheets and an anvil to receive and bend the staples driven from the head. When the bundle is to be stitched, the stitching unit moves perpendicular to a direction that the bundle is transported. The sheet processing apparatus according to the present invention also comprises a guide member attached between the head and the anvil to guide the bundle to a stitching position, and a supplement sheet guide member disposed upstream side of the guide member in a transport direction of the bundle. The supplement sheet guide will not contact a leading edge of the bundle, and retracts so that the supplement sheet guide does not hinder movements of the stitching unit when the stitching unit moves.

The supplement guide member can have an inclined contact portion that touches the stitching unit. When the stitching unit moves, the stitching unit abuts the inclined contact portion, and the supplement guide unit retracts not to obstruct the movement of the stitching unit.

In another aspect of this invention, the stitching unit has a roller that contacts the inclined contact portion.

The supplement guide member may be disposed on an upstream in a transport direction of the bundle where the supplement guide does not interfere with the movement of the stitching unit upon retracting.

The supplement guide member may be attached to the stitching unit so that when the stitching unit moves to a predetermined position, the supplement guide member retracts to a position where the supplement guide member does not interfere with movements of the stitching unit.

The sheet feeding apparatus of the invention can include an aligning means to align in a direction traversing a transport direction of the bundle; a moving means to move the stitching unit in a direction traversing a transport direction of the bundle; and a control means to control the moving means to adjust the position of the supplement guide member.

One aspect of the present invention provides an image forming apparatus comprising an image forming unit and a sheet processing apparatus for stitching the bundle of sheets with images formed by the image forming apparatus. The sheet processing apparatus can be the one described in any of the aspects mentioned above.

DETAILED DESCRIPTION OF PREFERRED EMBODIMENTS

Hereunder, embodiments of the invention will be explained with reference to the accompanied drawings.

Figure 1:
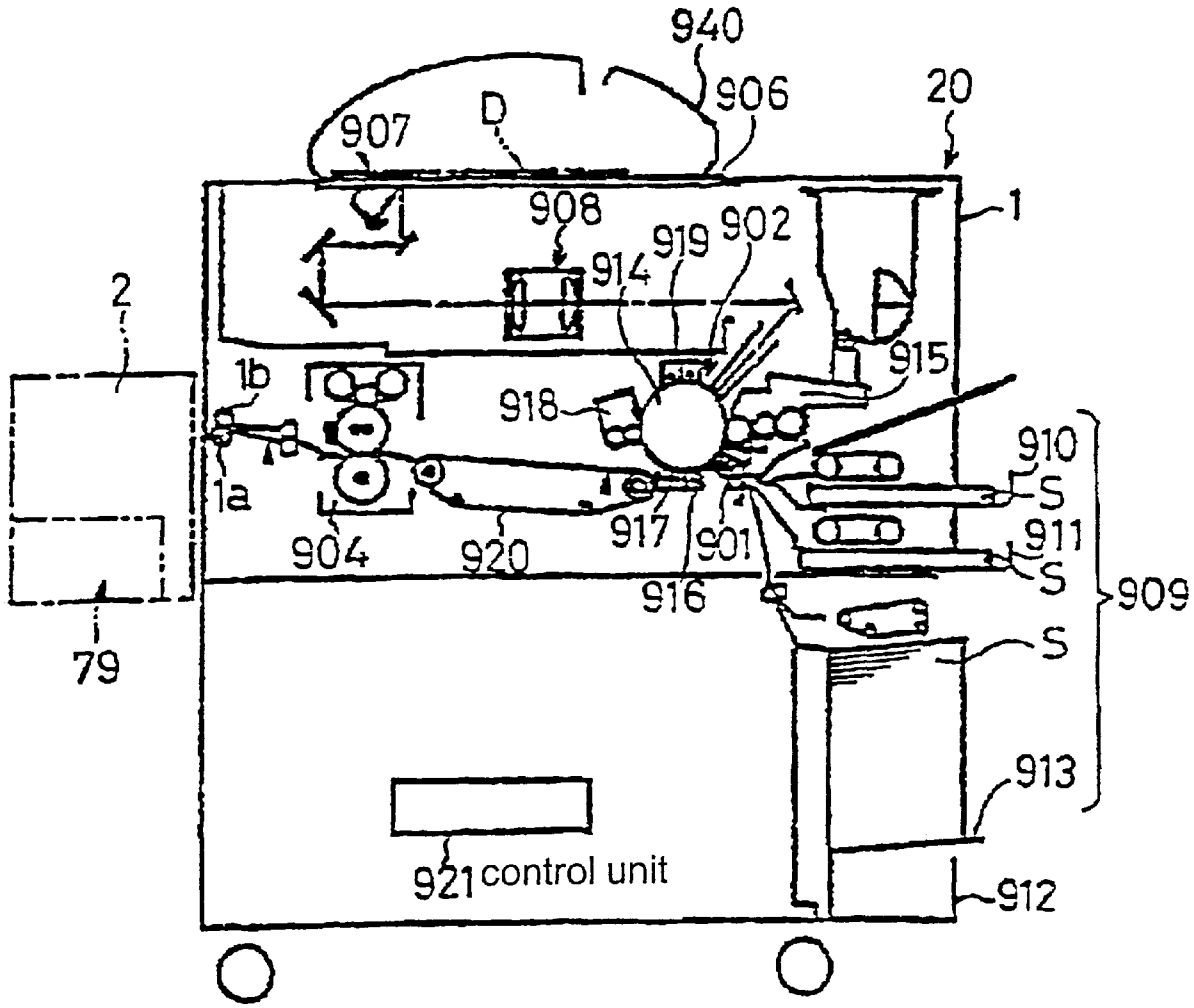
FIG. 1 is a view for a copier that has an image forming apparatus with a sheet processing apparatus according to the present invention.

FIG. 1 shows a structure of a copier as an example of an image forming apparatus with a sheet processing apparatus according to an embodiment of the present invention.

In the drawing, the main body 1 of the copier 20 comprises a platen glass 906 as a table for placing an original document, a light source 907, a lens system 908, a sheet feeder 909, and an image forming section 902. The main body 1 is provided with an automated document feeder 940 for automatically feeding an original document "D" to the platen glass 906. Additionally, a sheet processing apparatus 2 is mounted on the main body 1.

The sheet feeder 909 has cassettes 910 and 911 attached to the main body 1 for storing sheets of copy paper "S" and a deck 913 disposed on a pedestal 912. The image forming section (image forming means) 902 has a cylindrical photosensitive drum 914. Around the photosensitive drum 914, provided in the image forming section 902 are a developer 915, a separation charger 917, a cleaner 918, and a primary charger 919. At downstream of the image forming section 902, there are a feeding apparatus 920, a fixing device 904, and a pair of discharge rollers 1*a* and 1*b*.

Operations of the mechanisms inside the main body 1 of the copier 20 will be explained next. When a paper feed signal is sent from a control unit 921 disposed in the main body 1, the sheet "S" is discharged from the cassettes 910 and 911, or the deck 913. The light source 907 irradiates light to an original document "D" placed on the platen glass 906. The light is reflected by the document D and passed through the lens system 908 to a photosensitive drum 914.

The photosensitive drum 914, pre-charged by a primary charger 919, creates an electrostatic image thereon upon irradiation of the light. The developer 915 develops the electrostatic image to form a toner image. A resist roller 901 eliminates skew of the sheet of copy paper "S" fed from the sheet feeder 909, and then adjusts a feeding timing to an image forming section 902.

In the image forming section 902, the toner image on the photosensitive drum 914 is transferred to the sheet of copy paper "S". The sheet of copy paper "S" with the toner image is then charged to an opposite polarity to the transfer electrode 916 by the separating charger 917 to be separated from the photosensitive drum 914.

The feeding apparatus 920 transports the sheet of copy paper "S" to the fixing unit 904. The fixing unit 904 permanently fixes the image on the sheet of copy paper "S". After fixing the image, the sheet of copy paper "S" is discharged to the sheet processing apparatus 2 from the main body 1 by a pair of the discharged rollers 1*a* and 1*b*.

Figure 2:
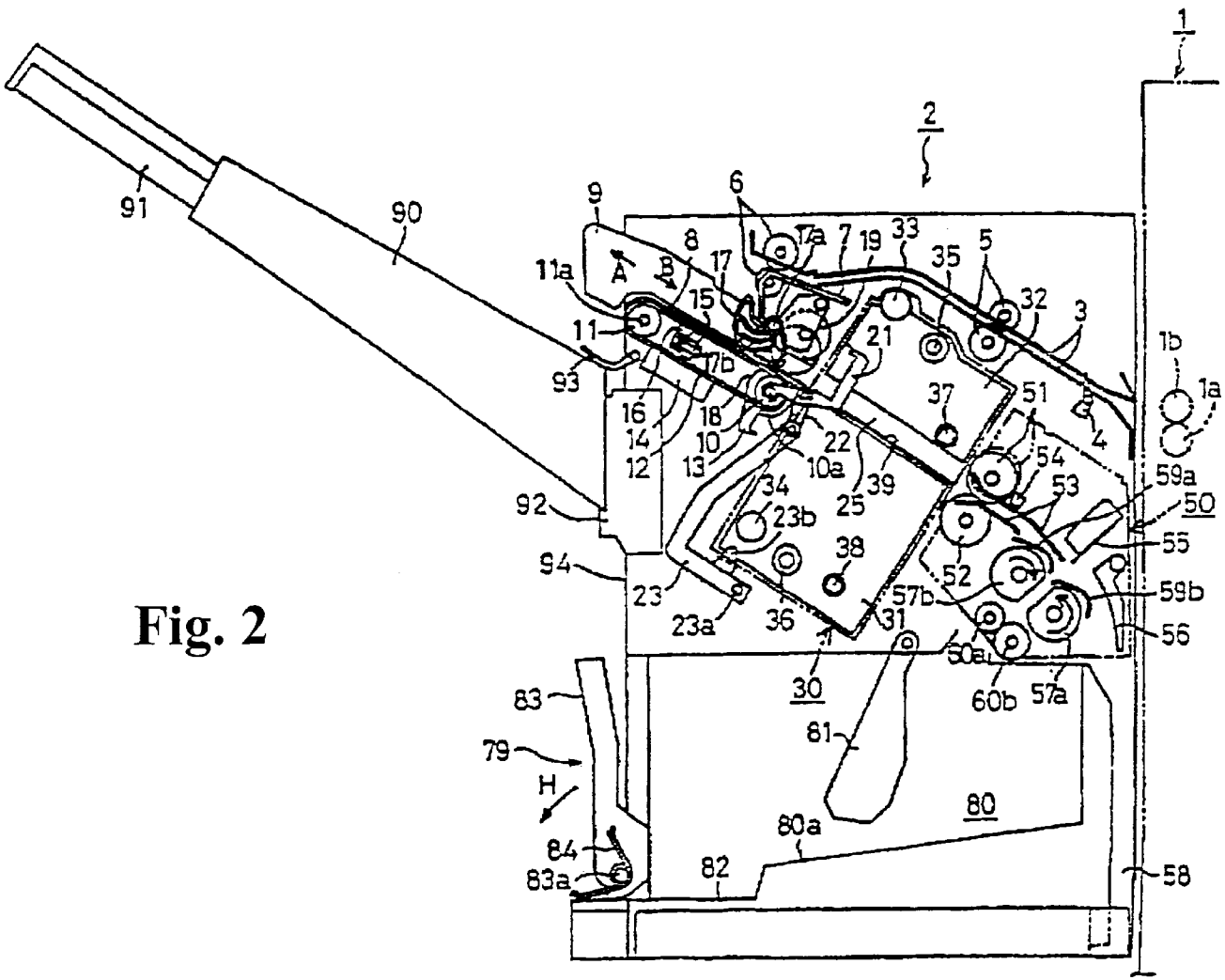
FIG. 2 is a side cross-section view of the sheet processing apparatus in FIG. 1.

FIG. 2 is a side cross-section view of the sheet processing apparatus 2. The sheet processing apparatus 2 is provided with a pair of feed guides 3, a sheet-detecting sensor 4, a processing tray 8, a saddle-stitching unit 30, and a folding unit 50. A pair of the feed guides 3 receives a sheet discharged from a pair of the discharge rollers 1*a* and 1*b*, and guides the sheet into the sheet processing apparatus 2. The sheet-detecting sensor 4 detects the sheet transporting in a pair of the feed guides 3.

The sheet-detecting sensor 4 determines a timing to align and whether or not the sheet is jammed inside of the feed guide 3. A pair of the discharge rollers 6 supports the sheet in the feed guide 3 sandwiched therebetween.

The processing tray 8 receives and stacks sheets discharged by a pair of the discharge rollers 6. A pair of aligning plates 9 is disposed on the processing tray 8 to guide and align both edges of the sheet in a width direction perpendicular to the sheet bundle transport direction.

Figure 3:
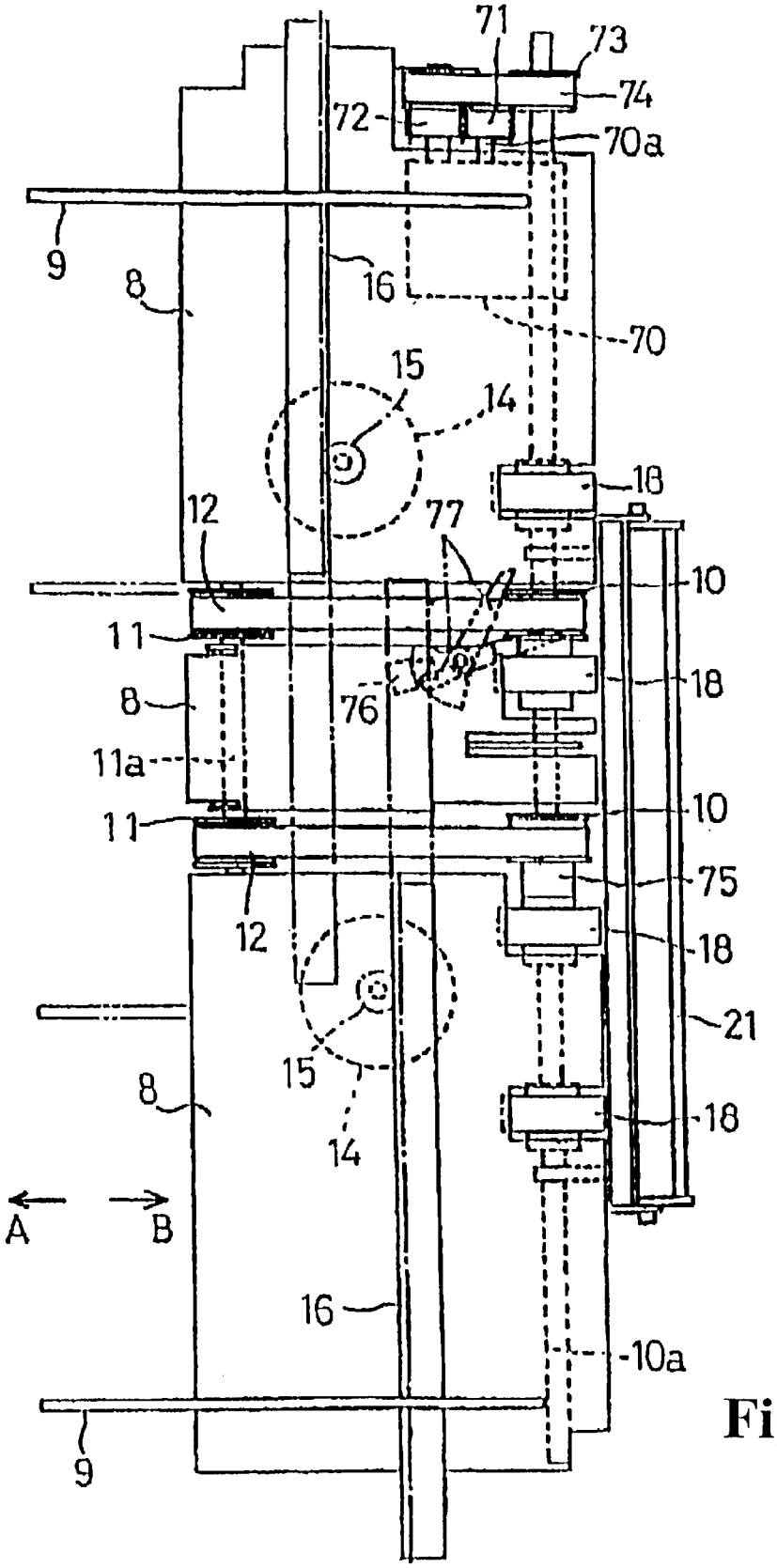
FIG. 3 is a top view of a processing tray of the sheet post-processing apparatus in FIG. 1.

Each of the aligning plates 9, as shown in FIG. 3, is attached to a side edge of the processing tray 8 in a width direction perpendicular to the sheet bundle transport direction. Each of the aligning plates 9 has a rack 16 that engages a pinion 15 disposed on a shaft of one of aligning motors 14 comprising a stepping motor disposed below the processing tray 8. The aligning plates 9 move by an appropriate distance in the sheet transport direction when the aligning motors 14 at a front side and a backside rotate.

Depending on a type of copier that the sheet processing apparatus is attached to, whether discharged sheets are aligned based on a center or edges, the embodiment of the invention can discharge sheets aligned at either a center of the sheets or edges.

In FIG. 2, the feed guide 7 guides a sheet discharged from a pair of the discharge rollers 6 into the processing tray 8. A paddle 17 is disposed below the feed guide 7. The paddle 17, which is made of a semicircular elastic rubber to secure grip, rotates around a center of a shaft 17*a* and contact an upper surface of a sheet.

The paddle 17 is also integrated with a fin 17*b* extending radially from a center of the shaft 17*a* and a paddle surface 17*c*. The paddle 17 deforms easily as sheets are stacked in the processing tray 8 to apply adequate force to the sheets so that the sheets can be transported properly.

The processing tray 8 has a first pulley 10 disposed on a first pulley shaft 10*a* and a second pulley 11 disposed a second pulley shaft 11*a*. A feed belt 12 is provided between the first pulley 10 and the second pulley 11. A pressing pawl 13 is disposed on the circumference of the feed belt 12.

The first pulley shaft 10*a* has a lower bundle feed roller 18 disposed thereon with the same axle. An upper feed roller 19 is provided above the lower bundle feed roller 18, and moves between one position (shown in a dotted line) where the upper feed roller 19 abuts the lower bundle feed roller 18 and another position (shown in a solid line) separated from the lower bundle feed roller 18.

Figure 4:
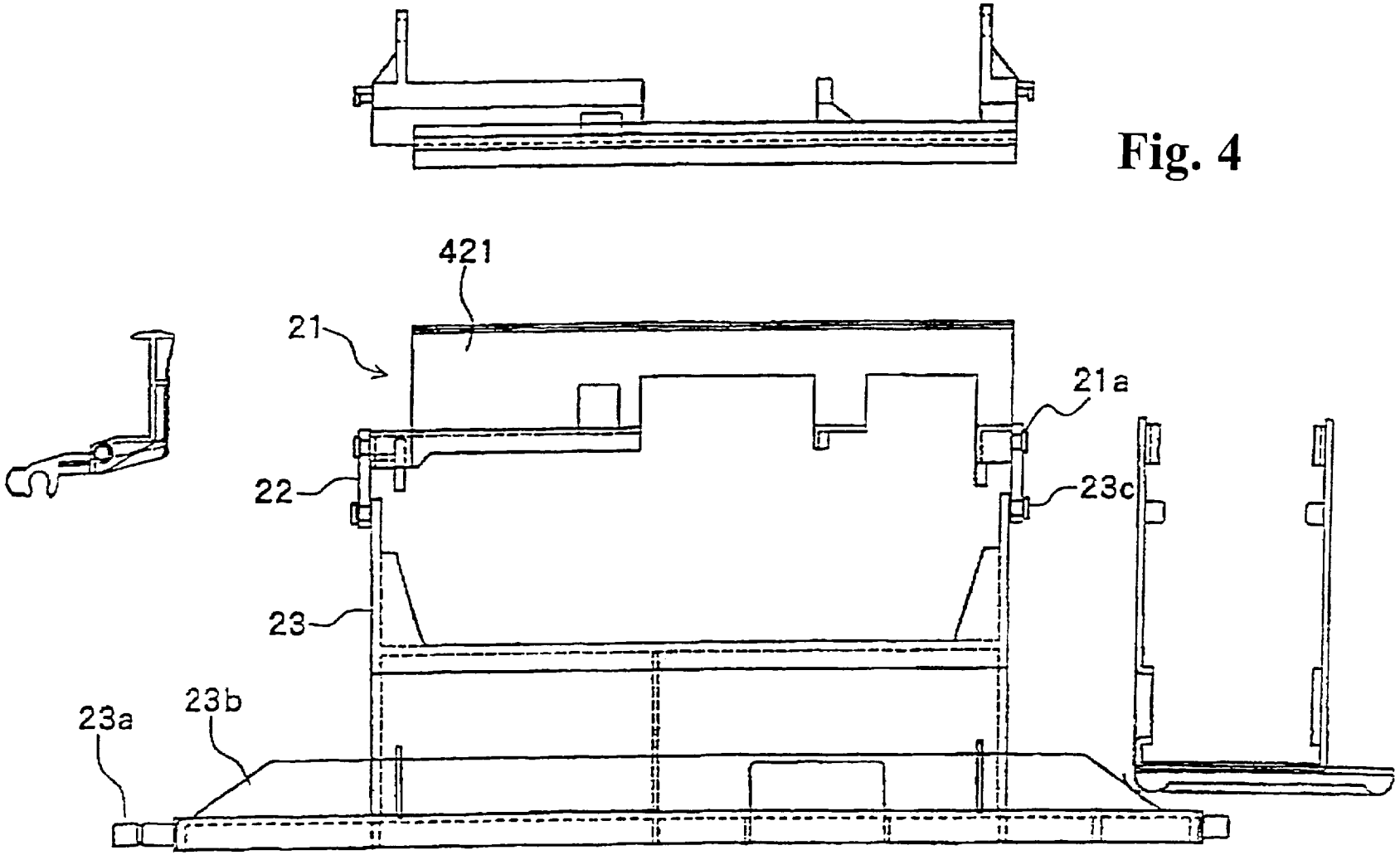
FIG. 4 is a front view of a stopper disposed in the sheet processing apparatus in FIG. 1.

A stopper 21 shown in FIG. 2 has a single stopper plate 421 extended in a width direction of the sheet as shown in FIG. 4. A pair of the discharge rollers 6 discharges a sheet, then the sheet drops by its own weight into the processing tray 8. The stopper plate 421 receives an edge of the sheet pushed by a rotation of the paddle 17. A moving arm 23 shown in FIG. 2 moves the stopper 21.

Figure 5:
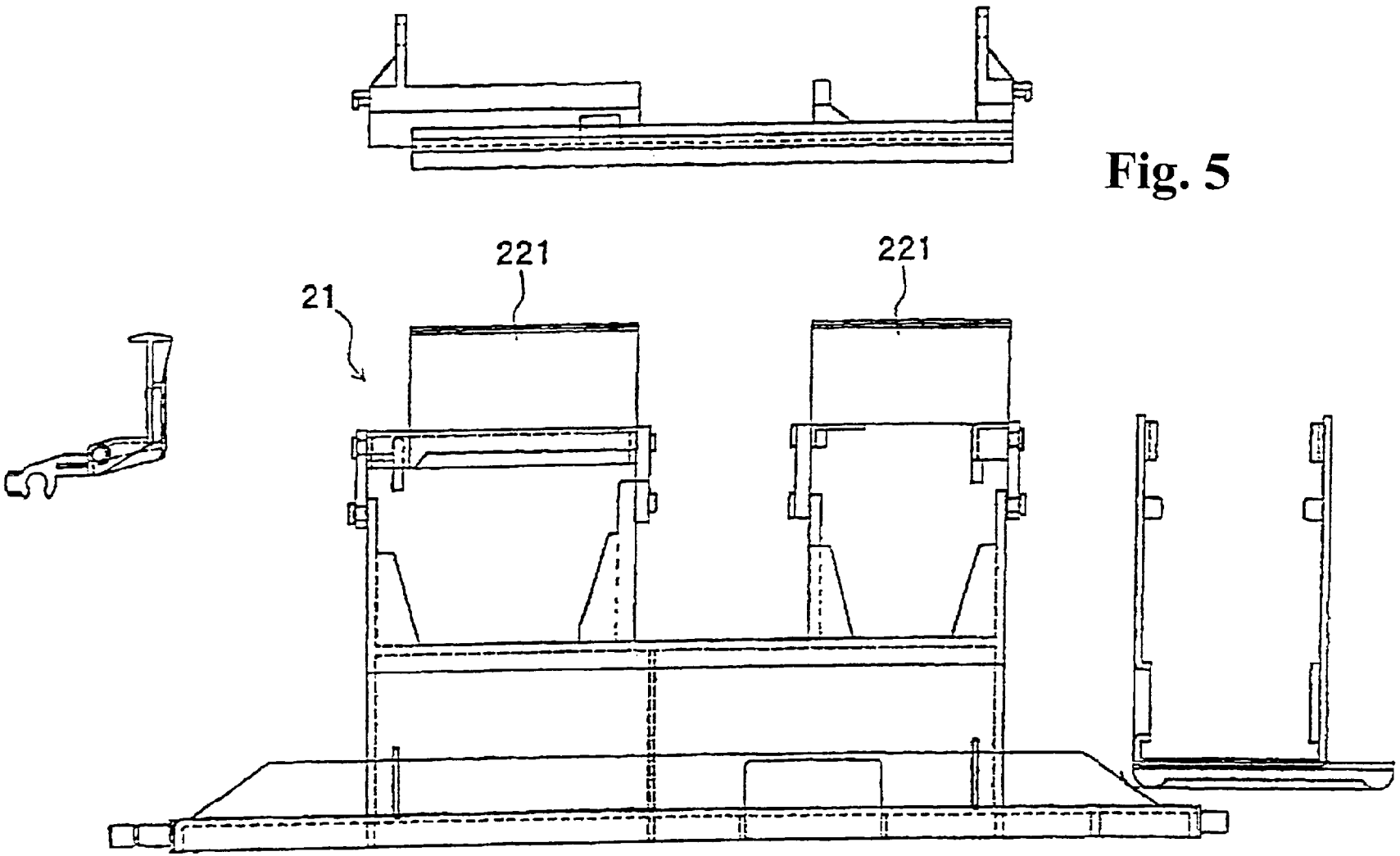
FIG. 5 is a front view of a stopper disposed in the sheet processing apparatus in FIG. 1.

One edge of the stopper 21, as shown in FIG. 2, contacts a first pulley shaft 10*a*, and the stopper 21 always protrudes by a spring (not shown) to limit an edge of a sheet. Although, in FIG. 4, the stopper 21 is formed of a single plate, alternatively, as shown in FIG. 5, the stopper 21 may be formed of a plurality of stopper plates 221 disposed in the width direction of a sheet.

The saddle-stitching unit 30 has a staple-driving head unit 31 having a staple cartridge (not shown) and an anvil unit 32 for bending the staple driven out of the staple-driving head unit 31. The staple-driving head unit 31 and the anvil unit 32 are disposed below and above a sheet bundle feed path 25 respectively and face to each other. The saddle-stitching unit 30 is constructed as a unit as shown by the dotted lines, and can be pulled out from the sheet processing apparatus 2.

The staple-driving head unit 31 and the anvil unit 32 can move on the sheet bundle feed path 25 disposed between the staple-driving head unit 31 and the anvil unit 32 in a direction perpendicular to a sheet transport direction (to right in FIG. 2). The direction is also along a surface of a sheet bundle facing the staple-driving head unit 31 and the anvil unit 32.

Guide rods 33 and 34 guide the staple-driving head unit 31 and the anvil unit 32, respectively, to move in the width direction thereof. Screw shafts 35 and 36 shift the staple-driving head unit 31 and the anvil unit 32. A head drive shaft 38 drives the staple-driving head unit 32 to drive staples, and an anvil drive shaft 37 drives the anvil unit 31 to bend the staples, respectively. The saddle-stitching unit 30 will be described in detail later.

Figure 6:
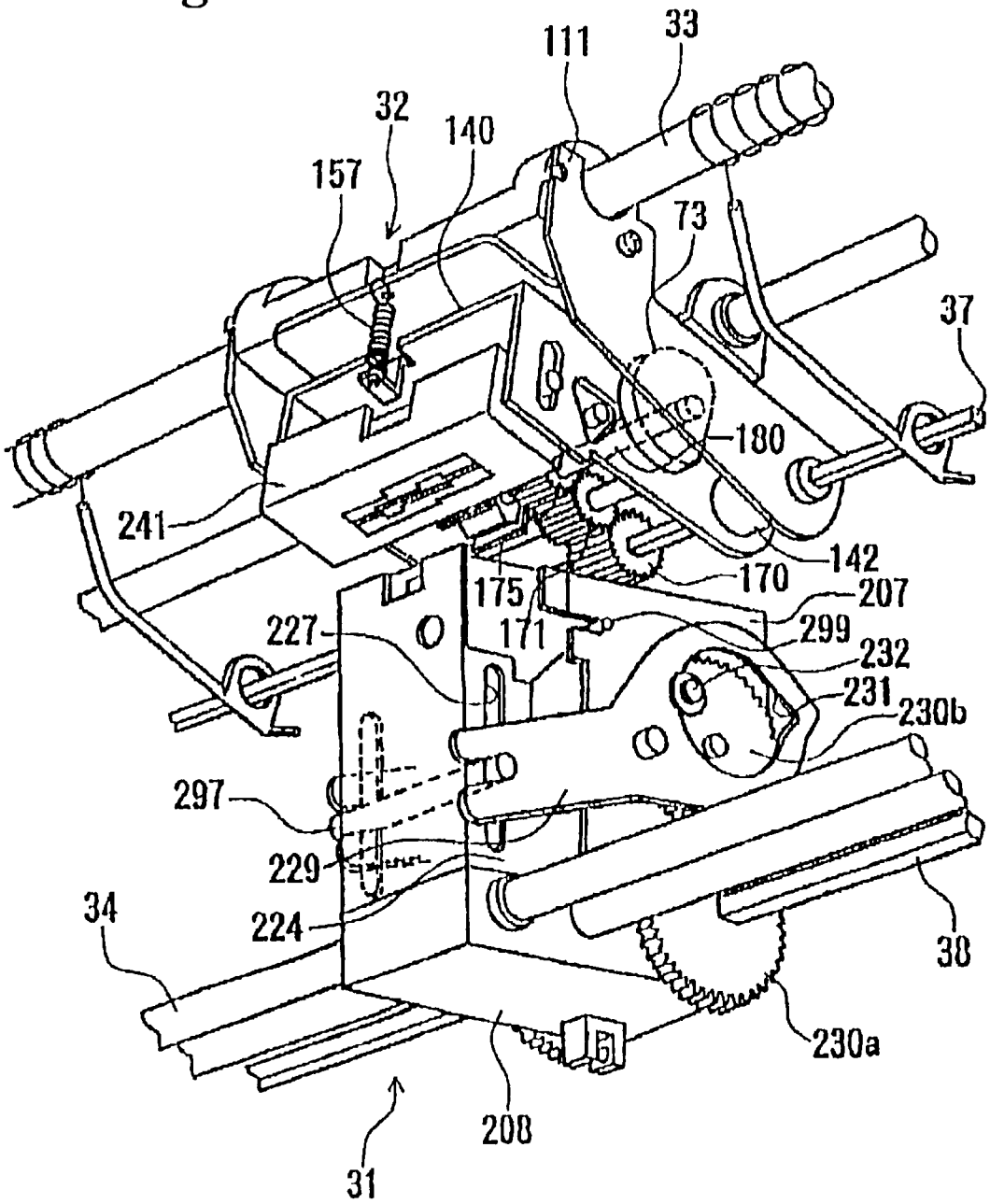
FIG. 6 is a perspective view of a saddle-stitching unit disposed in the sheet processing apparatus in FIG. 1.

A head housing 224, as shown in FIG. 6, is provided in the staple-driving head unit 31, and has a staple blade (not shown) that drives the staples. The head housing 224 is attached to a guide base block 208 that supports the head housing 224 and moves in a width direction.

The guide base block 208 has a guide rod 34 inserted therein. The guide rod 34 guides the staple-driving head unit 31 (head housing 224) to slide.

An attachment block 207 is provided on a side of the head housing 224. The attachment block 207 is equipped with transmission gears 230*a* and 230*b* and an arm 229 for driving the staple blade in the head housing 224 by a force of the head drive shaft 38.

A pin 232 is disposed on the transmission gear 230*b*. The pin 232 moves along a cam face 231 of the arm 229. When the pin 232 moves, a recess portion at a tip of the arm 229 transports a pin 297 attached to a staple blade inside the head housing 224 along a slit 227, thereby driving the staple blade to drive the staples.

Figure 7:
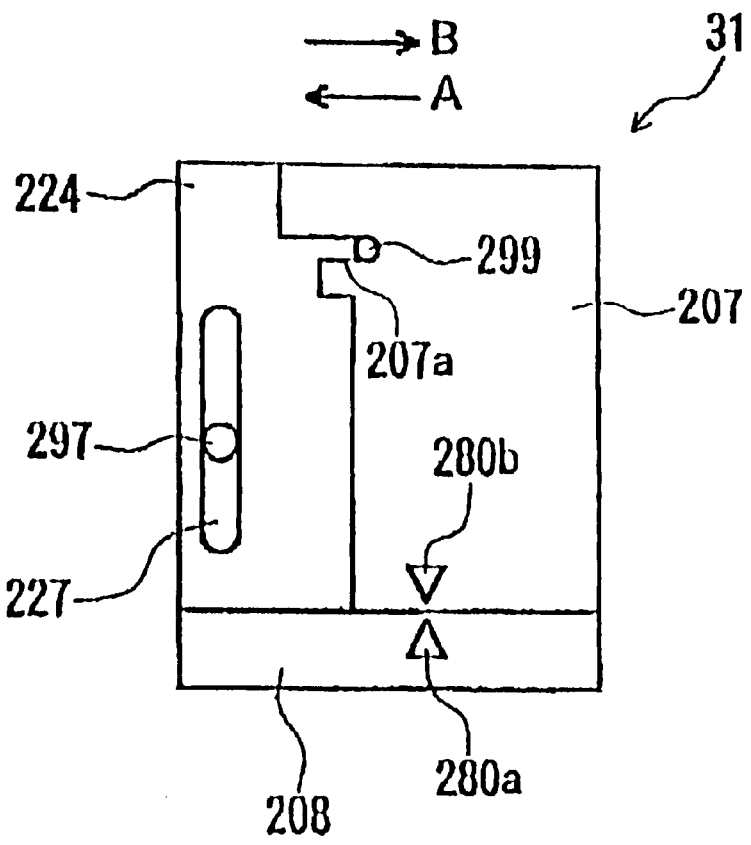
FIG. 7 is a view of an attachment block, a guide base block, and a head housing of the saddle-stitching unit.

In the embodiment, as sown in FIG. 7, the attachment block 207 can be detached from the head housing 224 (and the guide base block 208) in a direction shown by arrows A and B. In a usual state, a positioning pin 299 of the head housing 224 engages a recess 207*a* of the attachment block 207 for positioning and fixed with a screw (not shown).

The guide base block 208 and the attachment block 207 have the positioning sensors 280*a* and 280*b* placed thereon respectively. These positioning sensors 280*a* and 280*b* which are detection means can detect whether the attachment block 207 is attached to the guide base block 208 and the head housing 224 or not and detect whether the attachment block 207 is attached at a correct position or not.

Such an arrangement allows only the attachment block 207 to be removed upon clogging of the staple or similar troubles, thereby increasing maintenance efficiency. The arrangement also allows the head housing 224 having the staple driving staple blade to remain in the apparatus together with the guide base block 208. This does not deviate a precise relative position of the staple blade from an anvil body 241 (FIG. 6) even with the action of attachment and detachment upon maintenance, thereby preventing the staple from stitching error in operation after maintenance and assuring a secure saddle stitching.

Figure 8:
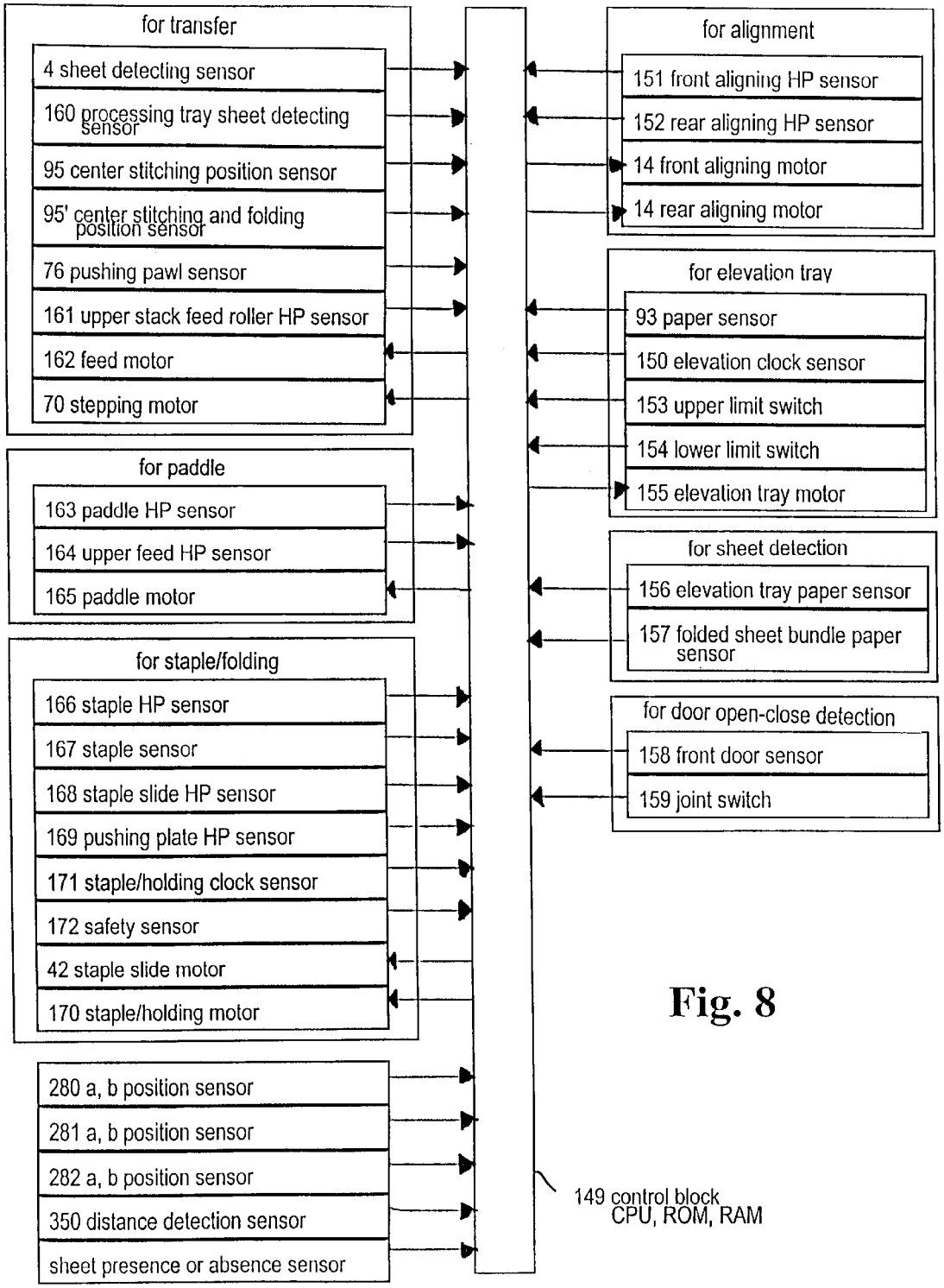
FIG. 8 is a processing diagram of the sheet processing apparatus in FIG. 1.

Further, detection results of the positioning sensors 280*a* and 280*b* are input to the control block 149 shown in FIG. 8. The control block 149 inhibits the staple driving head unit 31 and the anvil unit 32 from saddle stitching according to the detection results of the positioning sensors 280*a* and 280*b* if the attachment block 280 is not attached at all or has been attached in a position that is incomplete. Such an operation can prevent staple stitching error if a staple is clogged or not driven actually.

Figure 9:
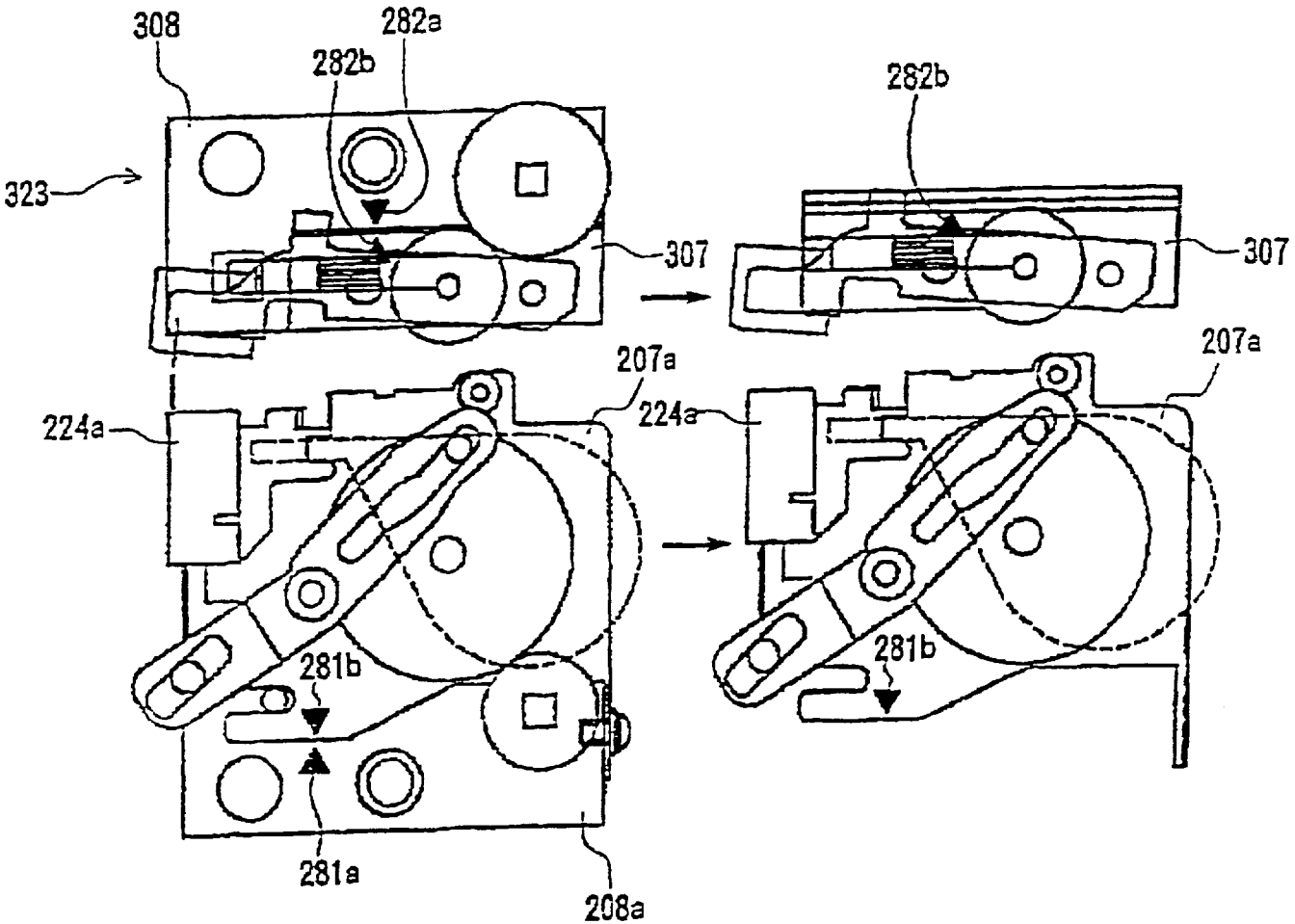
FIG. 9 is a view of another attachment block, a guide base block, and a head housing of the saddle-stitching unit in FIG. 7.

As for the saddle stitching inhibit control according to the detection results of the positioning sensors 280*a* and 280*b* when the attachment block 207 is mounted and removed as in FIG. 7, it may be made possible by such a construction type that the head 224*a* having the staple blade is integrated with the attachment block 207*a* as shown in FIG. 9. For that construction, the detection results are obtained by a positioning sensor 281*a* disposed on a guide base block 208*a* and a positioning sensor 281*b* disposed on the attachment block 207*a*.

As shown in the Figure, it also may be made possible by such an alternative construction that an anvil unit 323 is made of a guide base block 308 and a detachable attachment block 307. For that construction, the detection results are obtained by a positioning sensor 282*a* disposed on the guide base block 308 and a positioning sensor 282*b* disposed on the attachment block 307. That construction is the same as in FIG. 6.

Furthermore, according to this embodiment, it is controlled to prohibit the saddle stitching based on the positioning detection detected by the control block 149 on the sheet post-processing apparatus when the attachment block 207 is mounted and dismounted. However, it may also be made in an alternative way by using an additional control means formed in the saddle stitching unit 30 itself. Still a further alternative method would be to have the control unit 921 formed in the main body 1.

Figure 10:
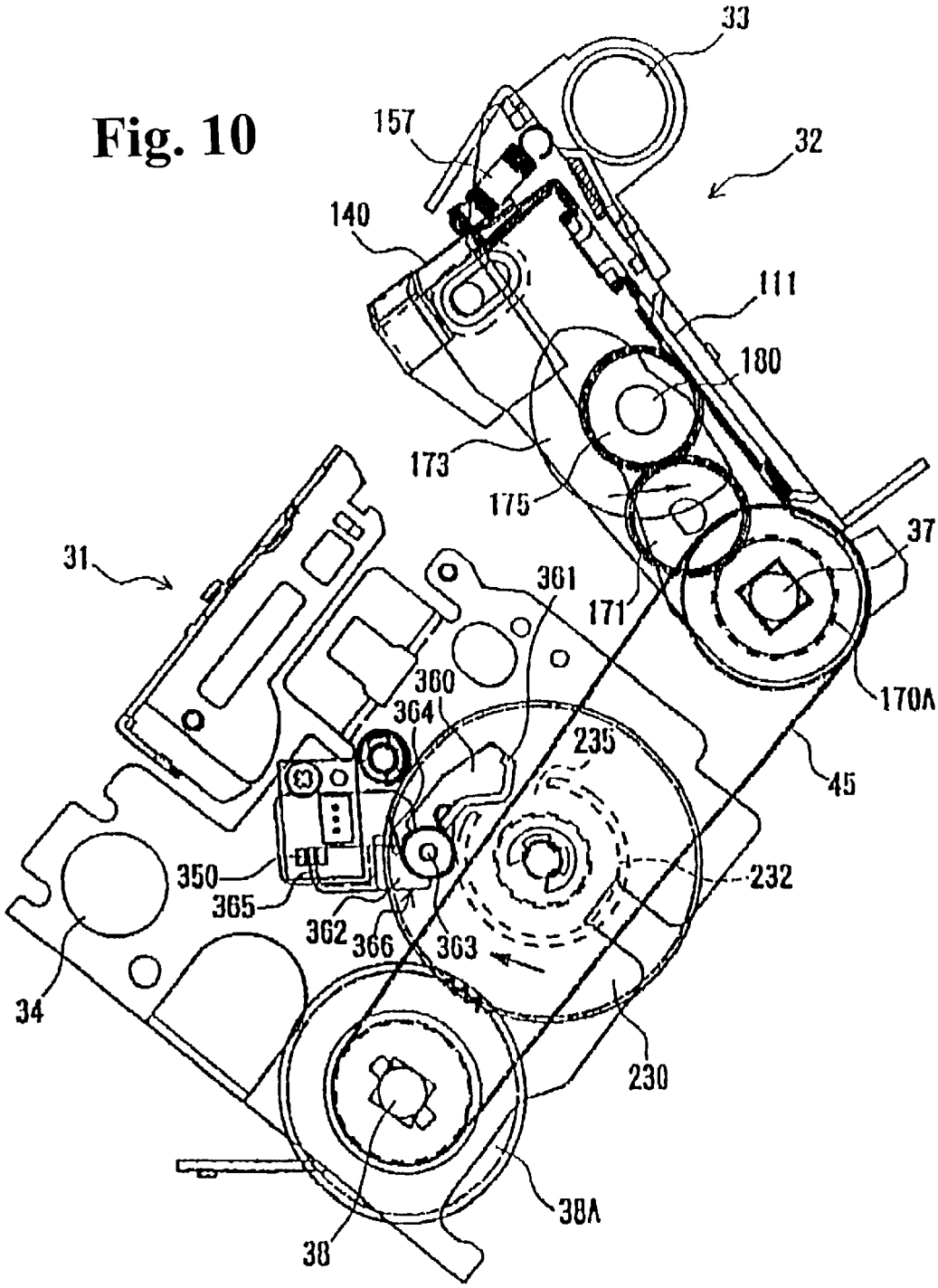
FIG. 10 is a view of a gap-detecting sensor disposed on the stitching unit.

In addition, FIG. 10 illustrates that the saddle stitching unit 30 has a gap detecting sensor 350 that can detect a space between the staple driving head unit 31 and the anvil unit 32. Further, the drive force of the drive shaft 38 is transmitted via a timing belt 45 and via a staple/folding motor 170A located on the anvil drive shaft 37 in the anvil unit 32 to a gear 175.

Figure 11:
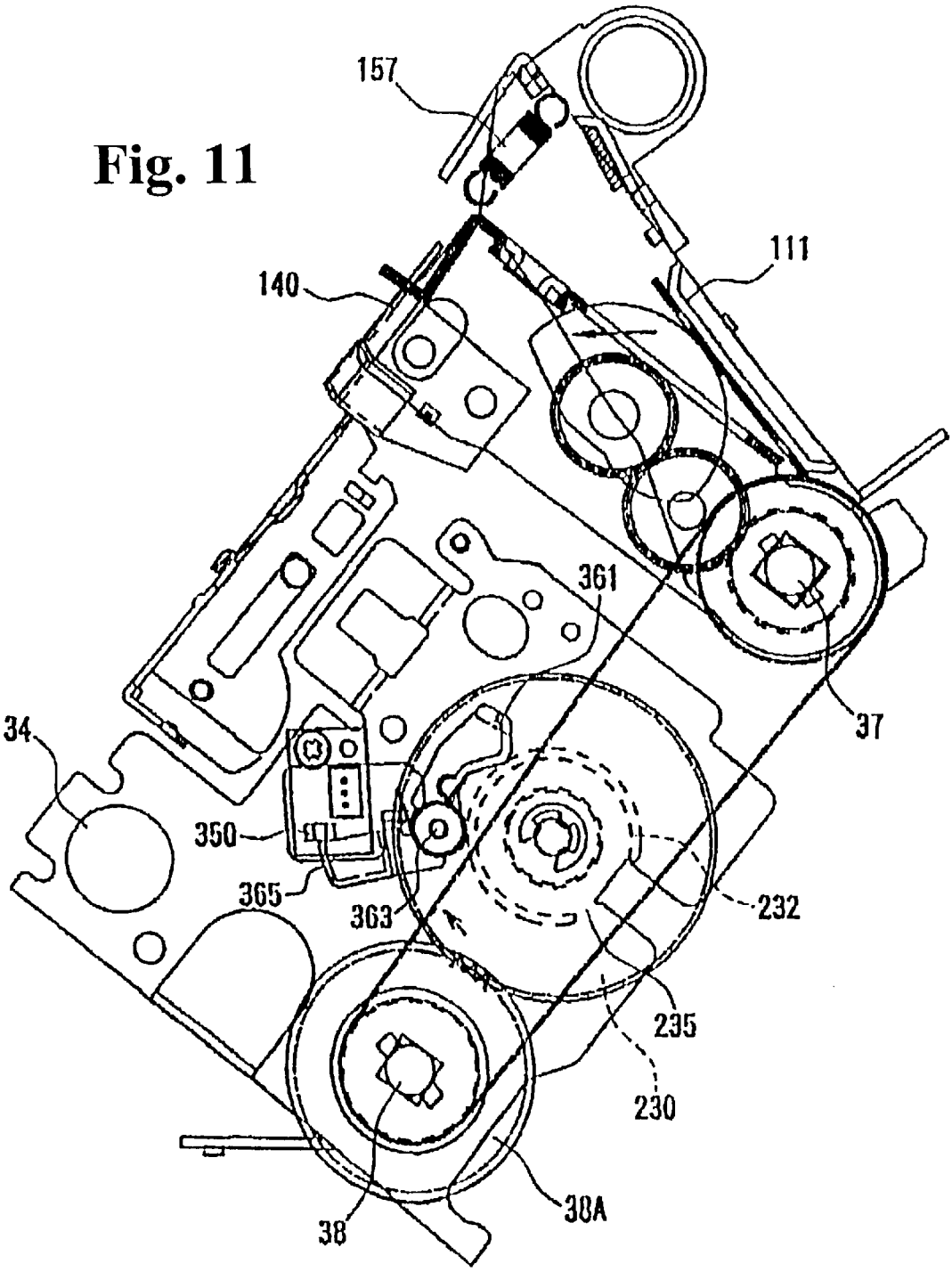
FIG. 11 is a view of a detecting operation of the gap-detecting sensor in FIG. 10.

With the gear 175 rotated, the cam 173 located on the rotating shaft 180 of the rotating shaft 175 on the gear 175 is pressed to a fixed frame 111 on the anvil unit 32. As a result, a movable frame 140 on the anvil unit 32 supported via a collar 37 on the anvil drive shaft 37 to swing freely, as shown in FIG. 11, resists against the urging force of the coiled spring 157 to separate from the fixed frame 111 toward the staple driving head unit 31.

The drive force of the head drive shaft 38 is transmitted to the gear 230 via the gear 38A located on the head drive shaft 38 in synchronization with the drive force of the head drive shaft 38 that moves the movable frame 140 of the anvil unit 32 via the timing belt 45.

The gear 230, as shown in FIG. 10, has a cylindrical cam 232 having a notch 235 formed thereon. A detecting lever 366 having an engaging portion 360 and a detecting end 362 provided thereon is disposed to swing freely with a center of the shaft 363 being pressed toward the cam 232 by a spring 364.

If the gear 230 is located at a position at which the gap between the staple driving head unit 31 and the movable frame 140 of the anvil unit 32 is fully opened, as shown in FIG. 10, the detecting lever 366 swings so that the engaging portion 360 can be put into the cutout 235 of the cylindrical cam 232 by the spring 364.

With the engaging portion 360 put into the cutout 235 of the cam 232, a detecting tip 365 of the detecting end 362 of the detecting lever 366 is moved to a position at which the detecting tip 365 is detected by the gap detecting sensor 350. As a result, the gap detecting sensor 350 detects the detecting tip of the detecting lever 366.

A signal from the gap detecting sensor 350, as shown in FIG. 9, is input to the control block 149. With the detection of the detecting tip 365 by the gap detecting sensor 350, it is decided that the space between the staple driving head unit 31 and the movable frame 140 of the anvil unit 32 is fully opened as shown in FIG. 10.

On the other hand, if the drive force of the head drive shaft 38 moves the movable frame 140 on the anvil unit 32 via the timing belt 45, as shown in FIG. 11, the gear 364 is rotated via the gear 38A located on the head drive shaft 38 in synchronization with the movement of the movable frame 140. The rotation force resists the urging force of the spring 364 to push the engaging portion 360 of the detecting lever 366 from the notch 235 to press to the engaging surface of the circular cam 232. The engaging portion 360 has a slant surface formed at the tip 360 thereof so that the engaging portion 361 can be pressed up to the engaging surface on the circular cam 232.

Thus, the detecting tip 365 of the detecting end 362 can not be detected by the gap detecting sensor 350 while the engaging portion 360 of the detecting lever detecting lever 366 is pressed to the engaging surface of the circular cam 232. As the gap detecting sensor 350 does not detect the detecting tip 365, the control block 149 decides that the space between the staple driving head unit 31 and the movable frame 140 of the anvil unit 32 is out of a full open status as shown in FIG. 10.

It is described so far that the control block 149 decides with the signal from the gap detecting sensor 350 whether or not the space between the staple driving head unit 31 and the movable frame 140 on the anvil unit 32 is fully open. Alternatively, a detection range of the gap detecting sensor 350 can be made wider to detect that the space between the staple driving head unit 31 and the movable frame 140 on the anvil unit 32 is made narrow from the full open state to a desired range.

The both units 31 and 32 must be usually moved in the width direction of the sheet bundle if saddle stitching is made at a plurality of positions in the width direction of the sheet bundle or if the staple driving head unit 31 and the anvil unit 32 are moved to a staple replacement position to replace the staples. For the saddle stitching unit 30 in this embodiment, however, the control block 149 inhibits the both units 31 and 32 from moving toward the width direction of the sheet bundle in the condition that the gap detecting sensor 350 detects that the both units 31 and 32 have a space therebetween narrower than a predetermined space (other than the full open status as in FIG. 10).

If the both units 31 and 32 are permitted to move in the width direction of the sheet bundle in the narrow space state, the sheet bundle positioned for saddle stitching at a loading portion between the both units 31 and 32 may contact the staple driving head unit 31 or the anvil unit 32 in a particular case, such as the sheet bundle is floated up by curling or if the sheet bundle is bulky due to too many number of sheets or too thick sheet bundle.

Upon contact with the sheet bundle, the posture of the sheet bundle that has been aligned once deforms. As a result, the sheet bundle is stapled in the deformation state. Therefore, in this embodiment, the posture of the sheet bundle could not be deformed by any contact if the space is detected to exceed the predetermined distance, that is, in the status shown in FIG. 10, the control block 149 then permits the both units 31 and 32 to move in the width direction of the sheet bundle.

However, as will be explained later, there could be a case that a sheet presence detection sensor (not shown) detects that the sheet bundle is not present in the space between the both units 31 and 32. The case occurs, as an example, if the sheet bundle does not reach the space between the both units 31 and 32 in the status that a preguide 370 for guiding the sheet bundle to a feed guide 39 is moved to a predetermined position and stands by, the preguide 370 being a supplement guide member for directing the sheet bundle toward the feed guide 39 which is a guide member for guiding the sheet bundle to the stitching position. This allows the staple driving head unit 31 and the anvil unit 32 to return to a home staple position that will be explained later.

The embodiment makes the above-described movement inhibit to control in the width direction of the sheet bundle by way of detecting the space between the both units 31 and 32 of the saddle stitching unit 30. The way of control can be applied to any type of a mechanism that a stapler having a head and an anvil mechanically combined together other than the saddle stitching can be moved along an edge of the sheet bundle to bind the edge at a plurality of positions. If the space between the head and the anvil is detected to be too narrow, the stapler may be inhibited from moving along the edge of the sheet bundle.

In place of the control block 149 on the sheet post-processing apparatus 2, alternatively, control means may be established in the saddle stitching unit 30 itself so that the control means can control to inhibit the both units 31 and 32 from moving in the width direction of the sheet bundle according to the gap detection between the both units 31 and 32. Still another alternative is that the control unit 921 of the main body 1 may be used to make the control for the image forming system.

The embodiment explained above has the anvil unit 32 moved toward the staple driving head unit 31 thereby changing the gap. Alternatively, the staple driving head unit 31 may be moved toward the anvil unit 32. Still a further alternative could be that both the units be moved toward each other.

It is alternatively possible to form a plurality of gap detection sensors in a structure to automatically set to a predetermined space by selecting a gap detection sensor to be used by control means according to conditions such as the number of sheets, the thickness of the paper of the sheet itself or the humidity or other conditions. The fixed carrying guide 39 guides the sheet stack carried inside the saddle stitching unit 30.

The folding unit 50 for the sheet bundle, on the other hand, is the unit indicated by chain double-dashed line in FIG. 2 and can be drawn out of the sheet post-processing apparatus 2 as in the saddle stitching unit 30. The folding unit 50 has a bundle feed guide 53, upper bundle feed roller 51, a lower bundle feed roller 52, a bundle detecting sensor 54 for detecting a leading edge of the sheet bundle, an abutting plate 55 which is the pressing means, the paired folding rollers 57*a* and 57*b* which are the paired rotating bodies, and leading guide 56 provided therein.

A stack feed guide 53 guides the sheet bundle nipped and fed between the upper feed roller 19 and the lower bundle feed roller 18 located at the inlet of the saddle stitching unit 30. The upper stack feed roller 51 is located at the inlet of the folding unit 50. The lower bundle feed roller 52 is arranged to face the upper bundle feed roller 51.

The upper bundle feed roller 51 is moved between a position (solid line) at which the upper bundle feed roller 51 is pressed to the lower bundle feed roller 52 and a separate position (dotted line). The upper bundle feed roller 51 is moved from the position separated from the lower bundle feed roller 52 to the contact position with the lower bundle feed roller 52 to nip and feed the sheet bundle together with the lower bundle feed roller 52 when the leading edge of the sheet bundle passes between the upper bundle feed roller 51 and the lower bundle feed roller 52 by the upper feed roller 19 and the lower feed roller 18 positioned at the inlet on the saddle stitching unit 30.

A stack detecting sensor 54 for detecting the leading edge of the sheet bundle presses the upper stack feed roller 51 against the lower bundle feed roller 52 when detecting the leading edge of the sheet bundle. The stack detecting sensor 54 is also used to set and control the folding position in the feed direction of the sheet bundle. The paired folding rollers 57*a* and 57*b* are cylindrical rollers having flat parts extending in a width direction thereof. Both the rollers are urged in the directions to press each other when rotated.

The abutting plate 55 is made of a stainless steel plate of around 0.25 mm thick at an edge thereof. The abutting plate 55 is positioned right above the paired folding rollers 57*a* and 57*b*, and a leading edge thereof can be moved close to the nips of the paired folding rollers 57*a* and 57*b*.

Around the upper portion of the paired folding rollers 57*a* and 57*b*, there are formed ark-like backup guides 59*a* and 59*b* to guide and feed the sheet bundle together with the stack feed guide 53. The backup guides 59*a* and 59*b* are interconnected to move with the abutting plate 55 moving up and down to make an opening around the sheet bundle for the paired folding rollers 57*a* and 57*b* when the leading edge of the abutting plate 55 moves close to the nips of the paired folding rollers 57*a* and 57*b*.

The leading guide 56 guides downward the sheet bundle nipped and fed by the upper stack feed roller 51 and the lower bundle feed roller 52 until the leading edge (the downstream edge) of the sheet bundle sags downward at a sheet bundle path 58. In the stack delivery rollers 60*a* and 60*b*, the roller 60*a* is a drive roller, and the roller 60*b* is a driven roller.

A sheet bundle stacking tray 80 for the folded sheet bundles, as shown in the Figure, can stack sheet bundles that have been folded by the paired folding rollers 57*a* and 57*b* and discharged out by the paired bundle discharge rollers 60*a* and 60*b*. The sheet bundle discharged inside the sheet bundle stacking tray 80 is pressed by the folded sheet holder 81 urged downward by a spring or its own weight.

In turn, the following describes the construction of the processing tray 8 and the saddle stitching unit 30 of the sheet processing apparatus 2 in detail.

First, the processing tray 8 is described below. The processing tray 8, as shown in FIG. 3, has a first pulley 10 and a second pulley 11 disposed virtually at a center thereof. The first pulley 10 and the second pulley 11 have a transfer belt 12 trained therebetween. On the first pulley shaft 10*a*, lower bundle feed rollers 18 are formed in two locations on each side of the sheet and substantially at the center of the sheet in the width direction thereof, the lower bundle feed rollers 18 being tire-like hollow rollers.

The first pulleys 10 are driven to rotate by the counterclockwise rotation of the first pulley shaft 10*a* in FIG. 2 with a one-way clutch 75 interposed between the first pulleys 10 and the first pulley shaft 10*a*, and made for free driving to stop by clockwise rotation of the first pulley shaft 10*a*. The first pulley shaft 10*a* is interconnected via the pulley 73 fixed to the first pulley shaft 10*a*, the timing belt 74, and gear pulleys 72 and 71 to the motor shaft 70*a* on the stepping motor 70 which serves as a source for the feed drive.

Therefore, the lower bundle feed roller 18 fixed to the first pulley shaft 10*a* is driven to rotate when the stepping motor 70 rotates to move the sheet on the processing tray 8 toward the staples in FIG. 2 (in the direction of the arrow B in FIGS. 2 and 3). The feed belt 12, however, is stopped because no drive force is transmitted thereto because of the one-way clutch 75. If the stepping motor 70 rotates to move the sheet toward the sheet elevator tray 90, the lower bundle feed roller 18 and the feed belt 12 rotate toward the sheet elevator tray 90 (in direction of arrow A in FIGS. 2 and 3).

Figure 12:
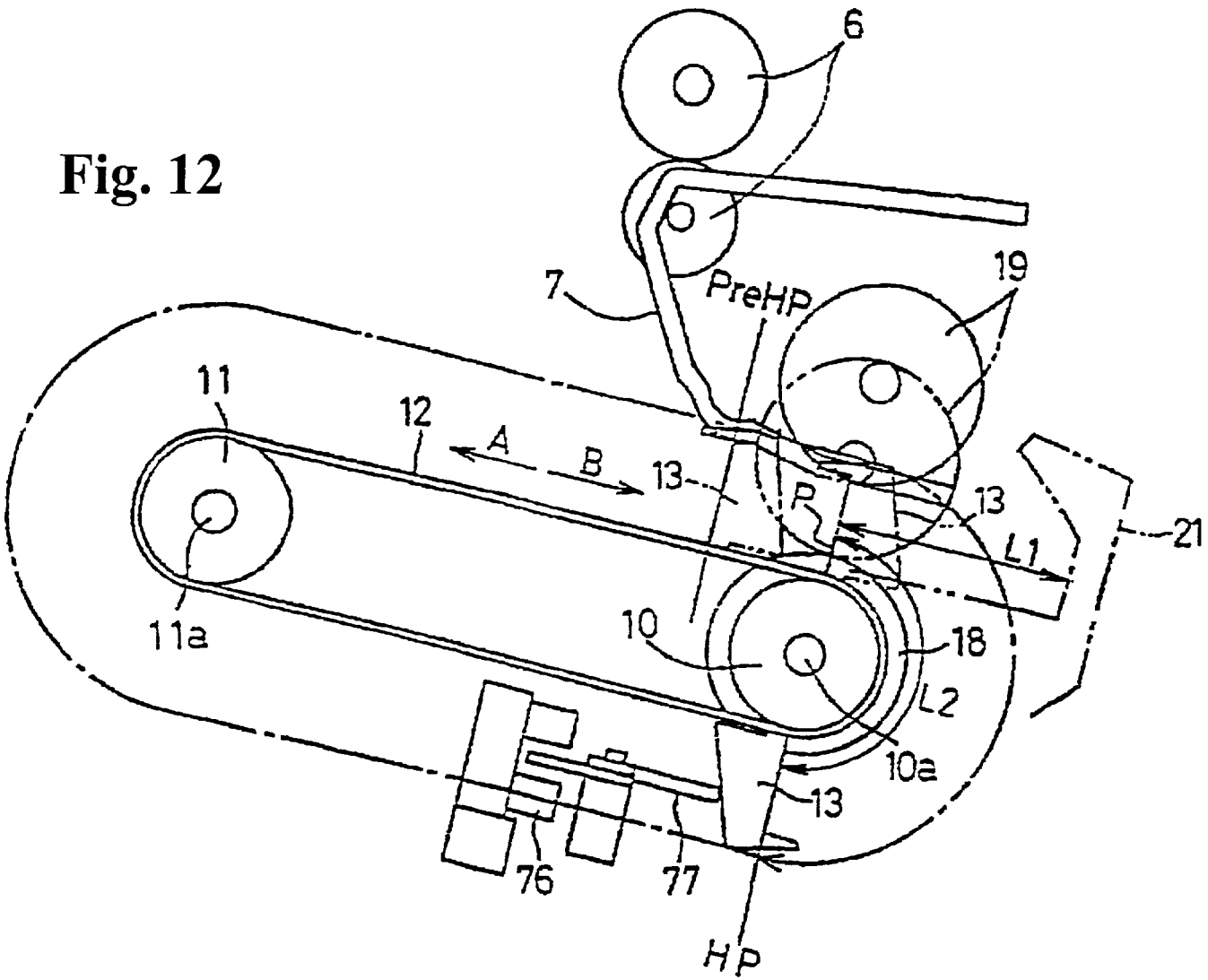
FIG. 12 is a top view of a transfer belt of the sheet processing apparatus in FIG. 1.

The transfer belt 12, as shown in FIG. 12, has a pushing pawl 13 disposed thereon. The processing tray 8 has a pushing pawl sensor 76 and a pushing pawl detecting arm 77 disposed thereunder to determine a home position thereof for the pushing pawl 13. In this embodiment, the home position (HP) is determined at the position where the pushing pawl sensor 76 is turned from OFF to ON as the pushing pawl detecting arm 77 is pressed by the pushing pawl 13 moved together with the feed belt 12.

In the Figure, let P denote a nip for the lower bundle feed roller 18 and the upper feed roller 19, L1 a length from the nip P to the stopper 21, and L2 a length from the nip P to the pushing pawl 13 along the feed belt 12. L1 and L2 are set as L1<L2.

In turn, the following describes the sheet feed operation of the processing tray 8 explained above in construction. To feed the sheet bundle to the elevator tray 90, first, a cam or the like (not shown) moves the upper feed roller 19 below the lower feed roller 19 to nip the sheet bundle together with the lower feed roller 19. Second, the stepping motor 70 (FIG. 3) is rotated to rotate the first pulley shaft 10*a* counterclockwise. The lower feed roller 19 then is rotated to move the sheet bundle toward the elevator tray 90 in the arrow A direction.

Note that also that the upper feed roller 19 is rotated by the stepping motor 70. Therefore, the sheet bundle is moved in the direction of the arrow A from the position of the stopper 21 inside the saddle stitching unit 30, by the rotation of the lower bundle feed roller 18 and the upper feed roller 19. When the sheet bundle passes the nip position P, the pushing pawl 13 hits with rotation of the feed belt 12. With the pushing pawl 13, the sheet bundle is fed to the elevator tray 13 while being pressed in the direction of the arrow A.

Because of L1<L2 in the length relationship mentioned above, the pushing pawl 13 presses the bottom of the sheet bundle upward (from the right side in FIG. 12), thereby always pressing the edge of the sheet bundle in an upright status. This does not cause excess stress in the transferring of the sheet bundle.

To feed the sheet bundle toward the saddle stitching unit 30 for saddle stitching, on the other hand, the pushing pawl 13 move counterclockwise from the HP position (FIG. 12) before receiving the sheet bundle moved from the stopper 21 by the paired rollers 18 and 19 synchronized therewith to feed the sheet bundle and push it out.

However, if the sheets fed into the processing tray 8 are not saddle-stitched by the saddle stitching unit 30, the sheet bundle does not need to move to feed the sheet bundle to the stopper 21 position. The stepping motor 70 is driven in advance to move the pushing pawl 13 from the HP position in FIG. 12 to a movement idle position (Pre-HP position) by a predetermined distance α from the nipping position of the lower bundle feed roller 18 and the upper feed roller 19 in a direction toward the elevator tray 90.

The distance (L2+α) from the HP position to the Pre-HP position can be set by changing a step number count of the stepping motor 70. If the present sheet processing apparatus 2 needs no saddle stitching for sheets, therefore, the sheets may not be transferred to the stopper 21, but the pushing pawl 13 can be moved to the Pre-HP position in advance to stack the sheets on the elevation tray 90 before pushing the sheet stack out. This means that the sheet post-processing apparatus 2 is available for a high-speed duplicating machine.

Note that if the Pre-HP position of the pushing pawl 13 is a position where the feed guide 7 and the top of the pushing pawl 13 overlap each other, as shown in the Figure, the sheets fed one by one can be securely stacked at the Pre-HP position where the pushing pawl 13 exists. Such an arrangement allows the pushing pawl 13 to deliver the sheet bundle to the elevator tray 90 quickly.

Figure 13:
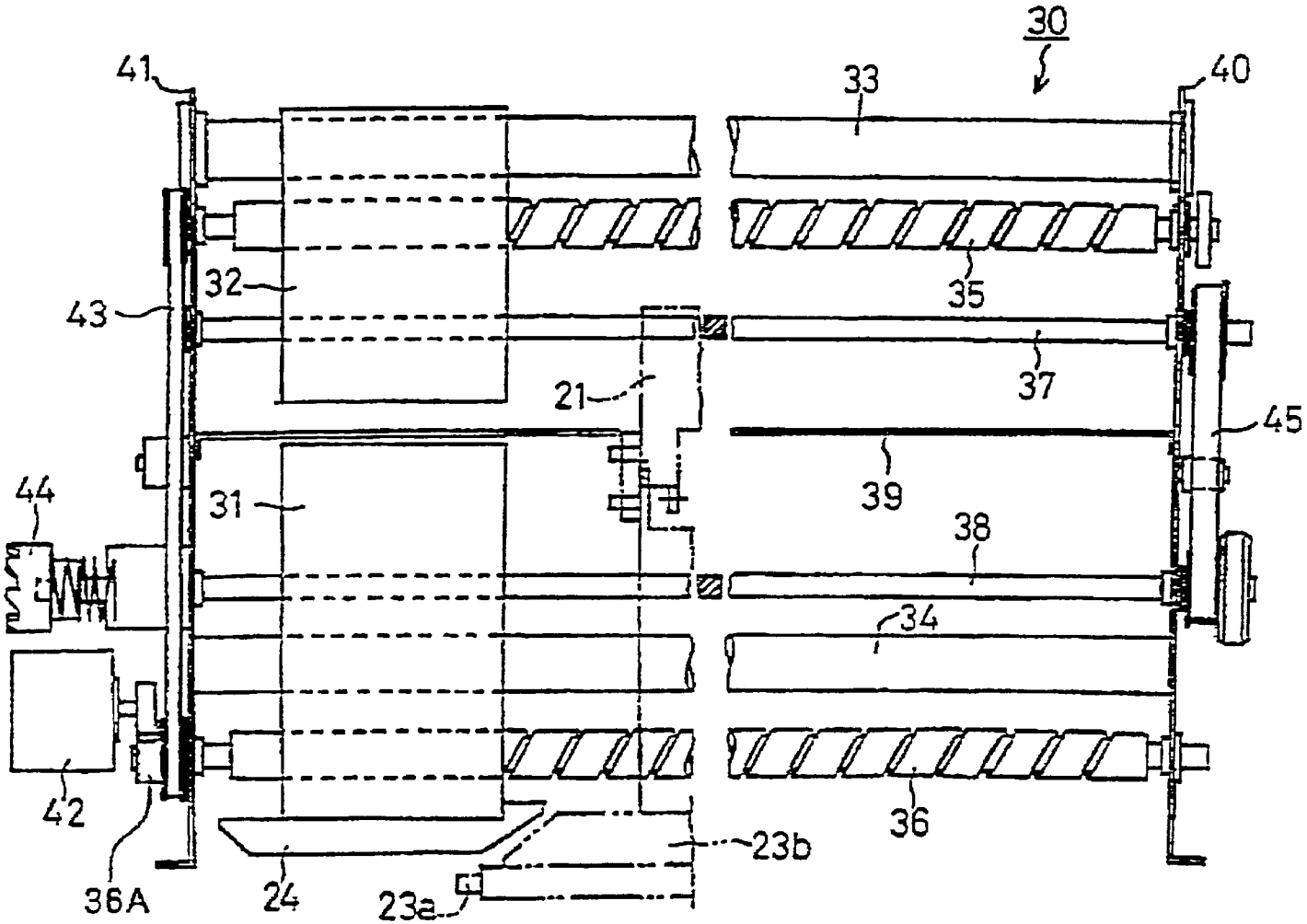
FIG. 13 is a view of a home position of the saddle-stitching unit in FIG. 7.

In turn, the following describes the saddle stitching unit 30. The saddle stitching unit 30, as shown in FIG. 13, has right and left unit frames 40 and 41, guide rods 33 and 34, screw shafts 35 and 36, and drive shafts 37 and 38 situated between the frames 40 and 41, the anvil unit 32 thereabout and the staple driving head unit 31 thereunder.

The screw shaft 36 is engaged with the staple driving head unit 31. The staple driving head unit 31 is moved in the horizontal direction in the Figure by rotation of the screw shaft 36. The anvil unit 32 also is arranged similarly.

The screw shaft 36 is connected with the stapler slide motor 42, which is the moving means, via the gear 36A outside the unit frame 41. Drive force of the stapler slide motor 42 is transmitted also to the anvil unit 32 by a timing belt 43. This allows the staple driving head unit 31 and the anvil unit 32 to move in a direction (horizontal direction in FIG. 13) without deviation of vertical positions thereof.

The stapler slide motor 42, therefore, can be driven to control the staple driving head unit 31 and the anvil unit 32 to move to a desired position depending on the width of the sheet, thereby allowing the staples to be driven at desired positions.

Figure 14:
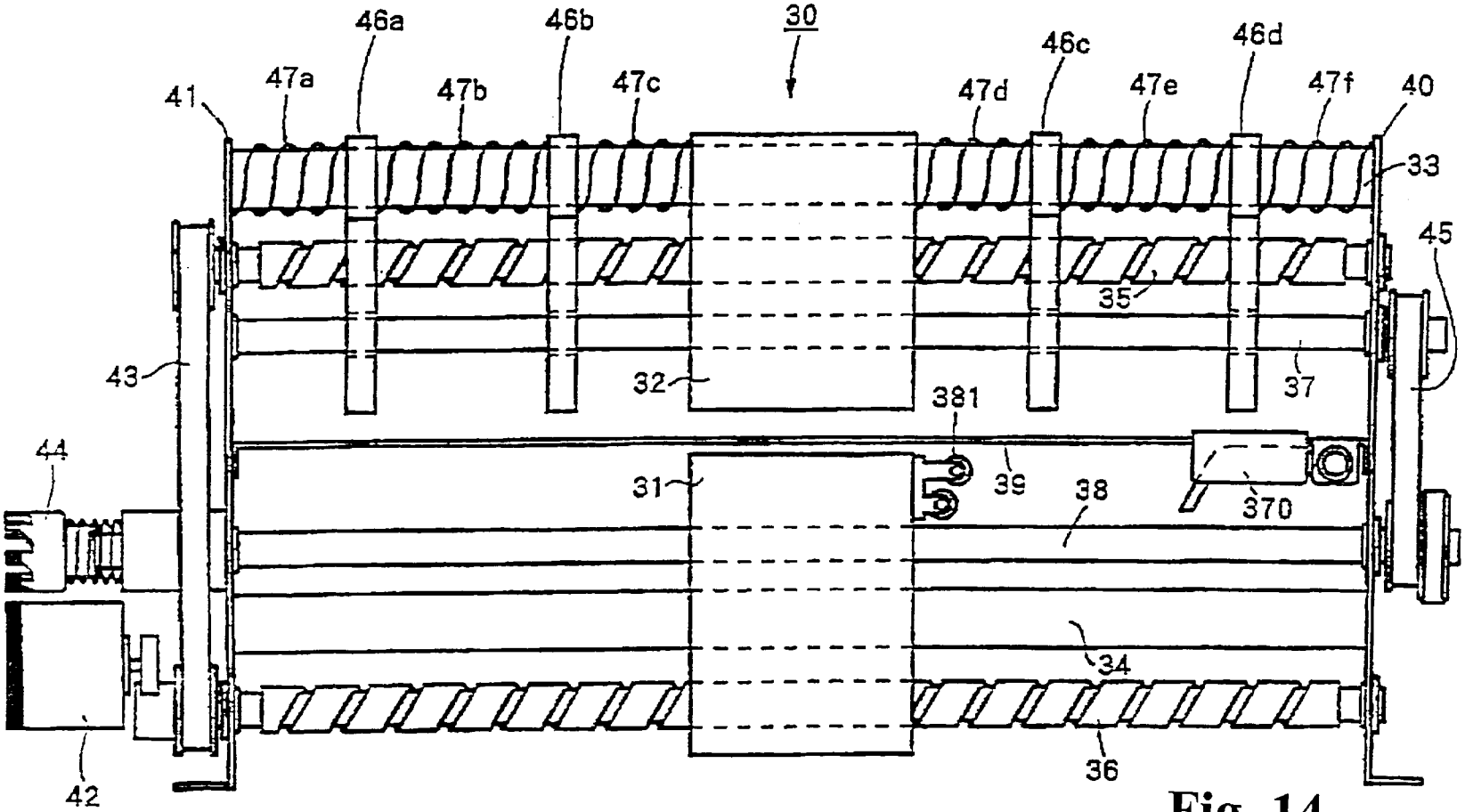
FIG. 14 is a front view of the saddle-stitching unit in FIG. 7.

Top guides 46*a*, 46*b*, 46*c*, and 46*d*, which are float preventing guide members, are movably supported on the guide rod 33 and the anvil drive shaft 37 above the sheet bundle feed path 25 (FIG. 2) in an area surrounded by the anvil unit 32 and the right and left unit frames 40 and 41 as shown in FIG. 14. A roller 381 and the preguide 370 are disposed on the head-unit 31.

Compression springs 47*a*, 47*b*, 47*c*, 47*d*, 47*e*, and 47*f* of an elastic material are interposed between the unit frame 41 and the upper guide 46*a*, between the upper guide 46*a* and the upper guide 46*b*, between the upper guide 46*b* and the anvil unit 32, between the anvil unit 32 and the upper guide 46*c*, between the upper guide 46*c* and the upper guide 46*d*, and between the upper guide 46*d* and the unit frame 41, respectively. The top guides 46*a*, 46*b*, 46*c*, and 46*d* move the upper guide rod 33 and the anvil drive shaft 37 in coordination with the movement of the anvil unit 32.

Figure 15:
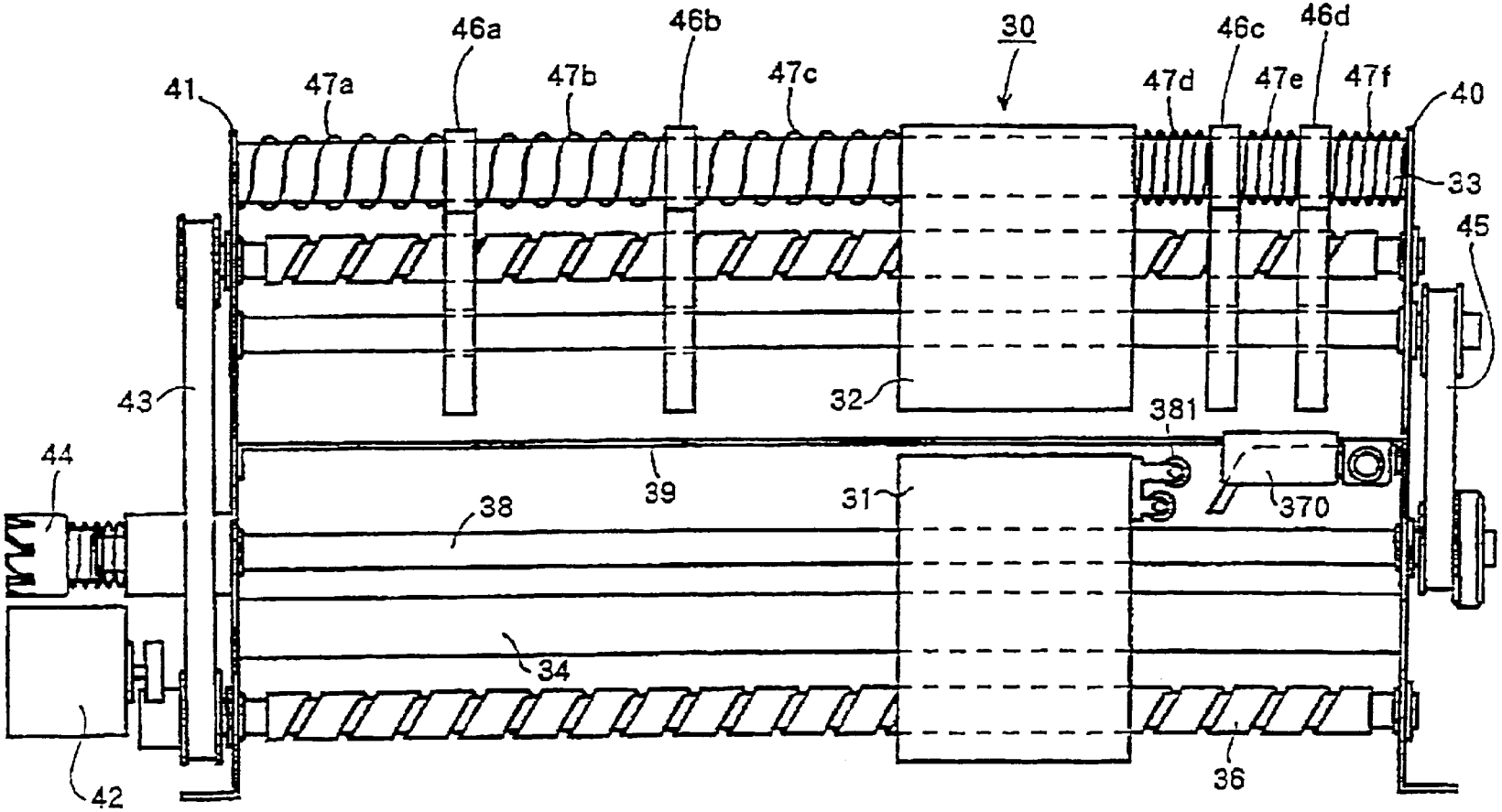
FIG. 15 is a front view for the saddle-stitching unit in a stitching position in FIG. 7.

As an example, if the sheet bundle is saddle stitched on a right side thereof, as shown in FIG. 15, the staple driving head unit 31 and the anvil unit 32 move to desired stitching positions on the right side from the position shown in FIG. 14 while keeping a relative positional relationship therebetween. Along with the movement, the compression springs 47*d*, 47*e*, and 47*f* on the right side are compressed by the anvil unit 32 in coordination with the movement of the anvil unit 32. The top guides 46*c* and 46*d* are moved to the right side as pushed by the compression springs 47*d* and 47*e*.

The compression springs 47*a*, 47*b*, and 47*c* placed to the left side of the anvil unit 32, on the other hand, are extended in coordination with the movement of the anvil unit 32. The top guides 46*a* and 46*b* also move to the right side to serve for guiding at desired positions depending on sheet stitching positions.

The drive forces for moving the head to drive the staples in the staple driving head unit 31, to move the staples, and to bend the staples in the anvil unit 32 are provided through the coupling device 44 from the sheet processing apparatus 2 and are also transmitted to the anvil unit 32 through the timing belt 45 on the unit frame 40.

Figure 16:
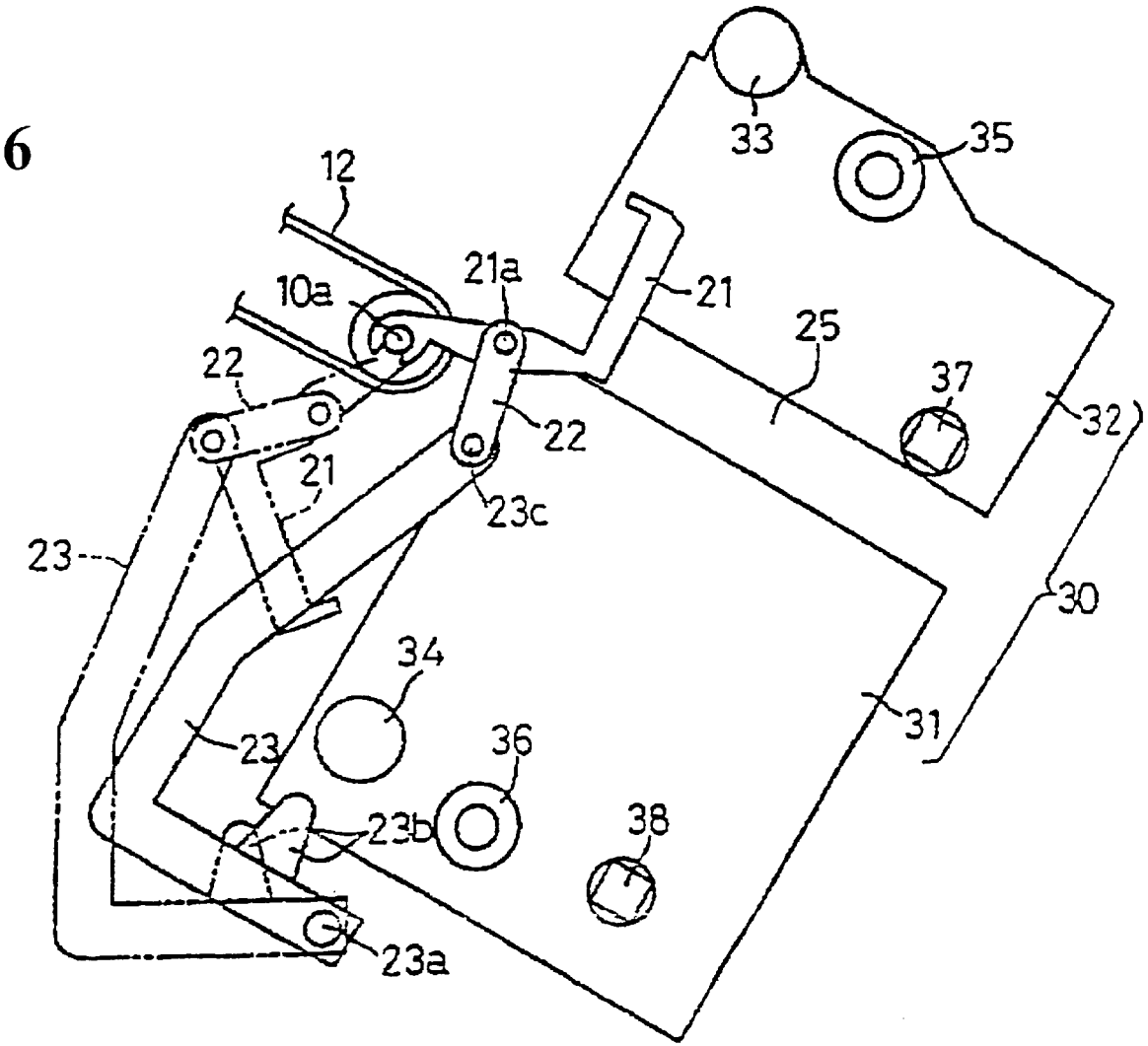
FIG. 16 is illustrating a stopper operation of the sheet processing apparatus in FIG. 1.
Figure 17:
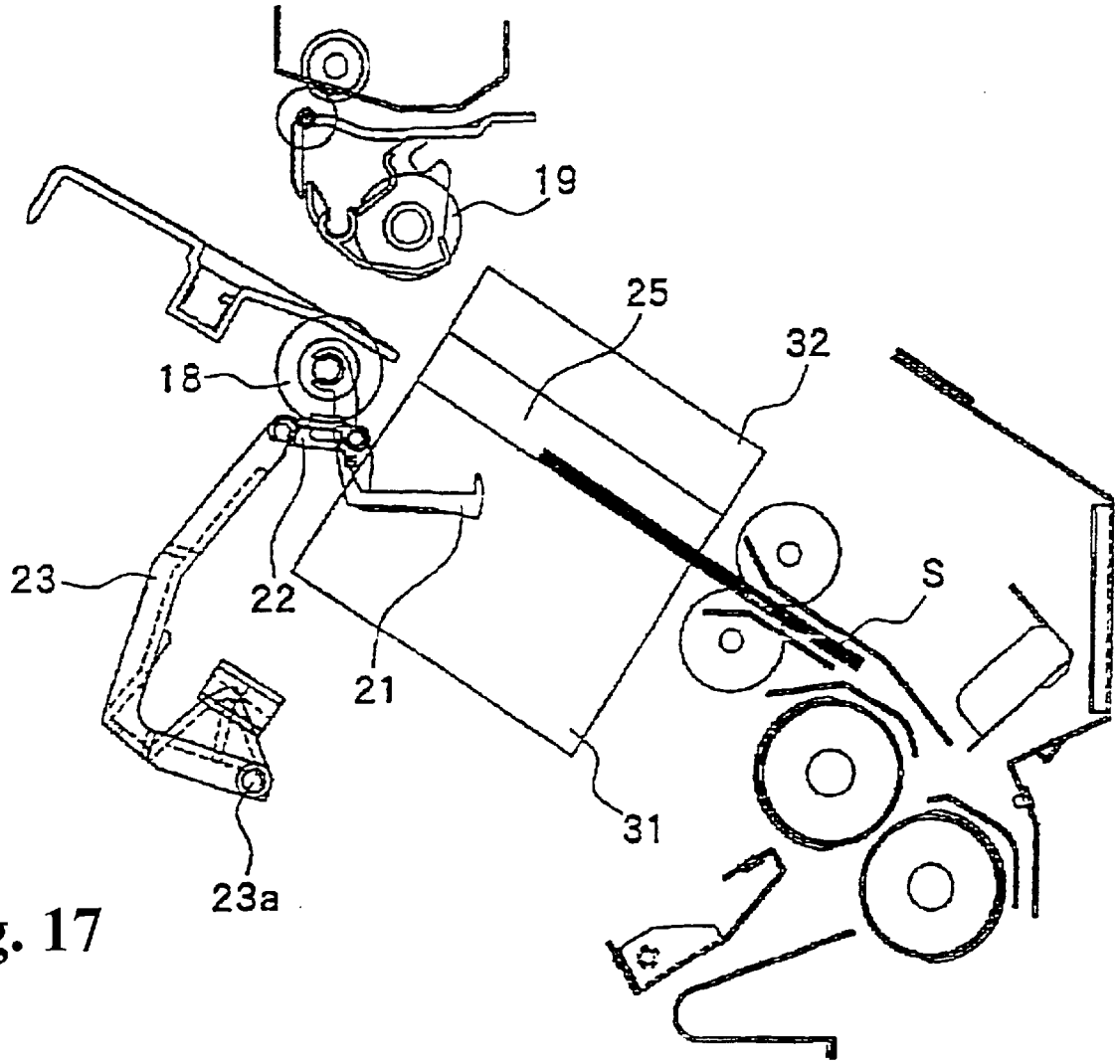
FIG. 17 is showing a relationship between a sheet bundle position and a stopper that is returned to a limiting position.

FIG. 16 shows parts of a side of the saddle stitching unit 30. The stopper 21 is connected with the moving arm 23 by the connecting pin 23*c*, the connecting lever 22, and the connecting pin 21*a*. The stopper 21 is pivoted by the first pulley shaft 10*a*.

The following describes the appearance and disappearance of the stopper 21 in the sheet bundle feed path 25 to set the staple driving positions on the edge of the sheet bundle with the staple driving head unit 31 moved in the width direction of the sheets, in reference to FIGS. 13 and 16.

Below the head unit 31, as shown in FIG. 13, the stopper abutting protrusion 24 is disposed to engage the stopper 21 with the moving arm 23. The movement of the head unit 21 causes the stopper abutting protrusion 24 to abut against the moving arm protrusion 23*b*, which in turn causes the moving arm 23 to rotate around the turning shaft 23*a* in the counterclockwise direction moving to the position of the dotted lines, as can be seen in FIG. 16. With the movement, the stopper 21, therefore, can not prevent the staple driving head unit 31 and the anvil unit 32 from moving in the width direction of the sheet bundle.

In the above-mentioned operational construction that the movement of the staple driving head unit 31 makes the stopper engaging projection 24 engage the moving arm projection 23*b*, a plurality of stoppers 221 forming the stopper 21 as shown in FIG. 5, may be alternatively placed in position and can all be saved from the staple path and the feed path 25.

In turn, the following describes the control operation of the sheet processing apparatus 2 with reference to FIG. 8. A control block 149 comprises a central processing unit (CPU), a ROM for storing control means in advance that the CPU executes, and RAM for storing the operational data of the CPU and control data received from the main body 1 of the copier 20. The control block 149 has I/O devices formed therein.

A block for aligning the sheets has a front aligning HP sensor 151 and a rear aligning HP sensor 152 for setting a home position (HP) of the aligning plates 9 that can align both edges of the sheets in the processing tray 8. The aligning plates 9 (FIG. 3) stand by at positions of the front aligning HP sensor 151 and the rear aligning HP sensor 152 until the first sheet is fed into the processing tray 8.

A front aligning motor 14 is a pulse motor for moving the front aligning plate 9, and a rear aligning motor 14 is a pulse motor for moving the rear aligning plate 9. The aligning motors 14 move the respective aligning plates 9 to align the width of the sheet bundle according to the width thereof. The aligning plates 9 can freely deviate each sheet bundle in the width direction.

A circuit for the elevator tray comprises a paper sensor 93 for detecting a top surface of the sheets thereon, an elevation clock sensor 150 for detecting the number of rotations of an elevator tray motor 155 with an encoder, and an upper limit switch 153 and a lower limit switch 154 to limit an elevation range for the elevator tray 90. Signals input from the paper sensor 93 and elevation clock sensor 150 and the upper limit switch 153 and the lower limit switch 154 control the elevator tray motor 155 to drive the elevator tray 90.

A block (relative to the sheet detection) for detecting whether or not a sheet or sheet bundle is stacked on the elevator tray 90 and in the sheet bundle stacking tray 80, is equipped with an elevator tray paper sensor 156 for detecting the presence on the elevator tray 90 and a sheet bundle stacking paper sensor 157 in the sheet bundle stacking tray 80. Those sensors 156 and 157 are also used as sensors for issuing alarms to an operator if any sheet remains before the sheet post-processing apparatus 2 is started or if a sheet bundle is not removed after a predetermined time elapses.

The block relative to a door open-close detection for detecting the opening of a door of the sheet processing apparatus 2 and whether or not the main body 1 of the copier 20 is properly mounted on the sheet processing apparatus 2 has a front door sensor 158 and a joint switch 159 for detecting whether or not the main body 1 of the image forming apparatus 20 has the sheet processing apparatus 2 mounted correctly.

The block (relative to sheet feed and bundle feed) for the sheet feed operation and the sheet bundle feed operation with the stacked sheets comprises a sheet detecting sensor 4 for detecting on the feed guide 3 that a sheet is fed from the main body 1 of the copier 20 to the sheet post-processing apparatus 2, a processing tray sheet detecting sensor 160 for detecting the presence of a sheet on the processing tray 8, a center stitching position sensor 95, a center stitching and folding position sensor 95' for detecting the leading edge of the sheet bundle in the feed direction to deduce the same position for folding the sheets as the staple driven position, a pushing pawl sensor 76 for detecting a home position of the pushing pawl 13 established on the feed belt 12 for transferring the sheet bundle on the processing tray 8 toward the elevator tray 90, and an upper stack feed roller HP sensor 161 for detecting the home position at which the upper stack feed roller 51 at an inlet of the folding unit 50 is separated away from the lower bundle feed roller 52. The circuit can control the feed motor 162 and the stepping motor 70 according to signals from the respective sensors.

The rotating force of the feed motor 162 is transmitted to the paired feed rollers 5, the paired discharge rollers 6, the upper stack feed roller 51, the lower bundle feed roller 52, and the paired stack discharge rollers 60*a* and 60*b*. The reverse rotation of the feed motor 162 turns the upper roller moving cam 68 to move the paired stack feed rollers 51. The rotating force of the stepping motor 70 is transmitted to the lower bundle feed roller 18 and the upper feed roller 19 formed on the processing tray 8 and the first pulley 10 to circulate the feed belt 12.

The block (relative to paddle) for controlling the paddle 17 comprises a paddle HP sensor 163 to detect the rotating position of the paddle 17 and an upper feed HP sensor 164 to detect the position where the upper feed roller 19 separates from the lower bundle feed roller 18, thereby controlling the paddle motor 165 according to signals from the sensors 163 and 164.

The block (relative to staple/folding) for controlling the staple/folding operation is comprised of a staple HP sensor 166 to detect that the staple driving head unit 31 and the anvil unit 32 in the saddle stitching unit 30 can drive staples, a staple sensor 167 to detect whether or not the staple driving head unit 31 has staples set therein, a staple slide HP sensor 168 to detect whether or not the sheet bundle is at a home position (FIG. 13) when start-moving in the sheet feed direction between the both units 31 and 32, a staple/folding clock sensor 171 to detect the rotation direction of the staple/folding motor 170 that can switch the drive of the saddle stitching unit 30 and the folding unit 50 to normal or reverse, and a safety switch 172 for detecting that the saddle stitching unit 30 and the folding unit 50 are operable. The circuit having the sensors and switches mentioned above controls the stapler slide motor 42 and the staple/folding motor 170.

The stapler slide motor 42 transmits the rotating force to the screw shaft 36 to move the staple driving head unit 31 and the anvil unit 32 in the width direction thereof. A gear 170 is arranged to drive the coupling device 44 (FIG. 14) for the saddle stitching unit 30 in one of the normal or reverse rotation direction or the coupling device 137 (FIG. 6) for the folding unit 50 in the other rotation direction.

Next, the following describes operations in the process modes of the sheet processing apparatus 2. This embodiment of the sheet processing apparatus 2 provides the following basic modes.

Non-staple mode: A mode for stacking the sheets onto the elevator tray 90 without stitching;

Side staple mode: A mode for saddle stitching the sheets at one or a plurality of positions on an edge (side) thereof in the sheet feed direction before loading the sheets onto the elevation tray 90;

Saddle staple mode: A mode for stitching the sheets at a plurality of positions on a half length of the sheets in the sheet feed direction and for folding and binding the sheets at the stitched positions before stacking the sheets onto the sheet bundle stacking tray 80.

At first, non-staple mode is explained. With this mode of process selected, the control block 149 drives the stepping motor 70 for rotating the transfer belt 12 to move the pushing pawl 13 at the home position (HP in FIG. 12) to the pre-home position (Pre-HP in FIG. 12) that is a sheet loading reference position on the processing tray 8 before stopping.

At the same time, the control block 149 drives the carrying motor 162 to rotate the pair of carrying rollers 5 and the pair of delivery rollers 6 and waits for a sheet to be delivered from the delivery rollers 1*a* and 1*b* of the main body 1 of the duplicating machine 20. After that, when the sheet is discharged, the paired feed rollers 5 and the paired discharge rollers 6 feed the sheet to the processing tray 8. Then, when the sheet detecting sensor 4 detects the sheet, start timings of the aligning motors 14 for the aligning plates 9 and the paddle motor 165 for rotating the paddle 17 are measured.

The control block 149 drives the aligning motors 14 and the paddle motor 165 while the sheet is discharged and stacked onto the processing tray 8. With the drive, the aligning plates 9 move in the width direction traversing the sheet feed direction to align the both edges of the sheet, and the paddle 17 is rotated to make one side of the edges of the sheets strike the pushing pawl 13 at the Pre-HP position to align the sheets. This operation is repeated whenever the sheet is discharged to the processing tray 8.

After that, if a predetermined number of sheets is aligned to the pushing pawl 13, the control block 149 stops the feed motor 162 and the paddle motor 165 from rotating, and also restarts the stepping motor 70 for driving the feed belt 12. With this operation, the sheet bundle is moved to the elevator tray 90 (the arrow A direction in FIG. 3) before being loaded on the elevator tray 90.

Along with the delivery of the sheet bundle, the control block 149 makes the elevator tray motor 155 move down to a certain distance in a downward direction of the elevator tray 90 once. Subsequently, it drives the elevator tray motor 155 upward until the paper sensor 93 detects the top sheet before stopping, and makes the elevator tray motor 155 idle until the following sheet bundle is loaded thereupon.

In turn, the side staple mode is described below. When the side staple mode is selected, the control block 149 drives the feed motor 162 to rotate the paired feed rollers 5 and the paired discharge rollers 6 to deliver a sheet from the main body 1 of the copier 20 to the processing tray 8 to stack. The control block 149 also drives the aligning motors 14 and the paddle motor 165 while the sheet is discharged and stacked. With this operation, the sheet is aligned on both edges in the width direction thereof by the aligning plates 9, and the leading edge of the sheet is transferred to the stopper 21 to stop. This operation is repeated for a specified number of sheets.

In the state where the sheet bundle is restricted by the stopper 21, the upper feed roller 19 is moved to the lower bundle feed roller 18 to make the upper feed roller 19 and the lower bundle feed roller 18 nip the sheet bundle. At that time, the staple driving head unit 31 and the anvil unit 32 are both positioned at the staple home position shown in FIG. 13.

The staple home position is a position where one stitching is made on the left unit frame 41 side shown in FIG. 13, that is, on the back side of the duplicating machine 20 and the sheet post-processing apparatus 2 shown in FIG. 1. Positioning the both units 31 and 32 for the staple home position is made by moving the both units 31 and 32 for a distance of a specific number of pulses from the HP sensor (not shown) disposed on the left unit frame 41 side shown in FIG. 13.

If the one-position stitching is specified, for example, the control block 149 makes the staple/folding motor 170 to be driven to rotate in the staple moving direction to make the both units 31 and 32 proceed with stitching. To stitch the sheets at a plurality of positions on the edge thereof, the stapler slide motor 42 should be driven to move the both units 31 and 32 from the staple home position to a desired staple position before proceeding with stitching.

After the stitching process is finished, the lower feed roller 18 and the upper feed roller 19 are rotated, and the transfer belt 12 is moved toward the elevation tray 90 side (arrow A direction in FIG. 3) by the stepping motor 70. This delivers the sheet bundle to the lower bundle feed roller 18, the upper feed roller 19, and pushing pawl 13 in this order before loading the sheet bundle onto the elevator tray 90. The operation of the elevator tray 90 is the same as in the nonstaple mode described above, so that an explanation shall be omitted.

In turn, the saddle staple mode is described below. Because the stacking of the sheets discharged from the copier 1 onto the processing tray 8 is similar to that of the side staple mode of operation described above, a description shall be omitted.

After the sheets are aligned and loaded on the processing tray 8, the upper carrying roller 19 is moved down to the lower carrying roller 18 side to make the upper carrying roller 19 and the lower carrying roller 18 nip the sheet stack. In turn, the stopper 21 is retracted away from the feed path 25 before the control block 149 drives the stapler slide motor 42 to transfer the sheet bundle in the arrow B direction in FIG. 3.

The drive allows the stopper engaging projection 24 on the staple driving head unit 31 also to move as shown in FIG. 13 to engage the moving arm 23. This retracts the stopper 21 from an area where the staple driving head unit 31 and the anvil unit 32 move, as shown in FIG. 16.

It should be noticed that the stopper 21 may be alternatively replaced by a single wide stopper plate 421 (FIG. 4) or a plurality of stopper plates 221 (FIG. 5) extending in the direction in which the staple driving head unit 31 moves along the guide rod 34, the direction being a direction orthogonal to the direction in which the sheets are delivered from the duplicating machine 20 to the sheet post-processing apparatus 2 or a direction orthogonal to the direction in which the sheet bundle is fed in the sheet bundle feed path.

By the engagement of the stopper engaging projection 24 of the staple driving head unit 31 with the moving arm 23, all the stopper plates are moved away from the moving area of the staple driving head unit 31 and the anvil unit 32 to make the sheet bundle feed path free.

In this embodiment, the stopper engaging projection 24 is disposed in the staple driving head unit 31. Alternatively, the stopper engaging projection 24 can be placed in the anvil unit 32 SO as to retract the stopper away from the moving area of the staple driving head unit 31 and the anvil unit 32 along with movement of the anvil unit 32 to make the sheet bundle feed path free.

In such a construction, the staple driving head unit 31 and the anvil unit 32 move from the home staple position shown in FIG. 13 along the guide rods 33 and 34 to open the sheet bundle feed path 25 free before stopping at the driving set positions in the width direction. The stopping positions of the both units 31 and 32, however, can be specifically controlled to change depending on the difference of the alignment reference by the aligning plate 9 and difference of the sheet size as will be described later.

Further, the control block 149 rotates the stepping motor 70 in a direction reverse to the non-staple and side staple modes in the process. This drive makes the sheet bundle feed in the direction reverse (the direction of the arrow B in FIGS. 2 and 3) to the elevator tray 90. If, in the transfer, the stack detecting sensor 54 in the folding unit 50 detects a leading end of the sheet stack in the carrying direction (sheet size data), the upper carrying roller 19 and the lower carrying roller 18 carry and stop the sheet stack to a position at which the approximate middle position in the sheet carrying direction coincides with the stitching position according to the sheet length information in the carrying direction sent in advance.

It should be noticed that if the stepping motor 70 rotates in the reverse direction, the one-way clutch 75 interposed between the first pulley 10 and the first pulley shaft 10*a* for tightly stretching the transfer belt 12 prevents the rotating force of the stepping motor 70 from transmitting but keeps the transfer belt 12 and the pushing pawl 13 stopped at the home position.

Next, the control block 149 rotates the staple/folding motor 170 for driving the drive shaft 38 and the anvil drive shaft 37 to rotate in the directions for operation thereof to stitch. When there requires a plurality of stitchings at a plurality of positions, the stapler slide motor 42 is driven to rotate the screw shafts 35 and 36 to move to the specific positions in the width direction before stitching.

After saddle stitching the sheet bundle at a single position or a plurality of positions, the both units 31 and 32 are moved from the final stitching position to the home staple position shown in FIG. 13 along the guide rods 33 and 34. This disengages the stopper engaging projection 24 of the staple driving head unit 31 from the moving arm 23. As a result, the stopper 21 (stopper plate 421 or 221) returns to the moving area of the both units 31 and 32, closes the feed path 25, and prepares for the alignment of the leading edge of the next sheets.

Accordingly, in a stroke of the both units 31 and 32 moving from the staple home position to the staple position and returning again to the staple home position, the position for retracting the stopper 21, the position for stitching process, and the position for returning the stopper in the sheet bundle feed path 25 are already set. In the stroke, there is also set the position for a preguide 370 (which will be described later) to guide the sheet bundle.

It should be noticed that timing when the both units 31 and 32 move from the position for stitching the final sheet bundle to the position for allowing the stopper 21 to return to the feed path 25 do not need to wait until the sheet bundle having the finished stitching is entirely delivered from the sheet post-processing apparatus 2. If a trailing edge of the sheet bundle S in the feed direction has passed over the stopper 21 as shown in FIG. 27, for example, the stopper 21 can be moved to the position for returning into the feed path 25.

Therefore, alternatively, the both units 31 and 32 may start to move at an instance when the both units 31 and 32 reach a position to which the stopper 21 is returned after the trailing edge of the sheet bundle has passed over the stopper 21 with reference to the size of the sheet, a sheet bundle feed speed, and other factors. Such a scheme can make it fast to make ready for accepting a next sheet stack.

The leading edge of the sheet bundle may be caught at an upstream edge of the feed guide disposed in a lower casing 30A having the staple driving head unit 31 of the saddle stitching unit 30 shown in FIG. 28 attached thereto when the sheet bundle passes over the stopper 21 moved to the retracted position to the stitching position. This causes the sheet bundle to be deformed in posture and the sheets to be stacked, resulting in incorrect saddle stitching.

To prevent such a failure, in the embodiment, the preguide 370 is provided at an upstream side of the feed guide. The preguide 370 guides the sheet bundle to the feed guide 39 without allowing the leading edge thereof to touch the upstream edge of the feed guide 39 when the sheet bundle is fed to the stitching position.

The preguide 370, as shown in FIG. 28, is disposed to project higher than the feed guide 39 to prevent the leading edge of the sheet bundle from being caught by the upstream of the feed guide 39. Also, the preguide 370 has a slope 370*a* provided for guiding the sheet bundle above the feed guide in the projection direction to prevent the leading edge of the sheet bundle from touching the upstream edge of the feed guide 39 after the preguide 370 abuts against the sheet bundle.

With a preguide 370, the sheet bundles can be guided to the feed guide 39 without the leading edges thereof catching on an upstream side of the feed guide 39. The sheet bundles led to the feed guide 39 can be firmly supported in the width direction by the feed guide 39. The sheet bundles can be correctly saddle stitched by the staple-driving head unit 31 and the anvil unit 32.

Figure 19A:
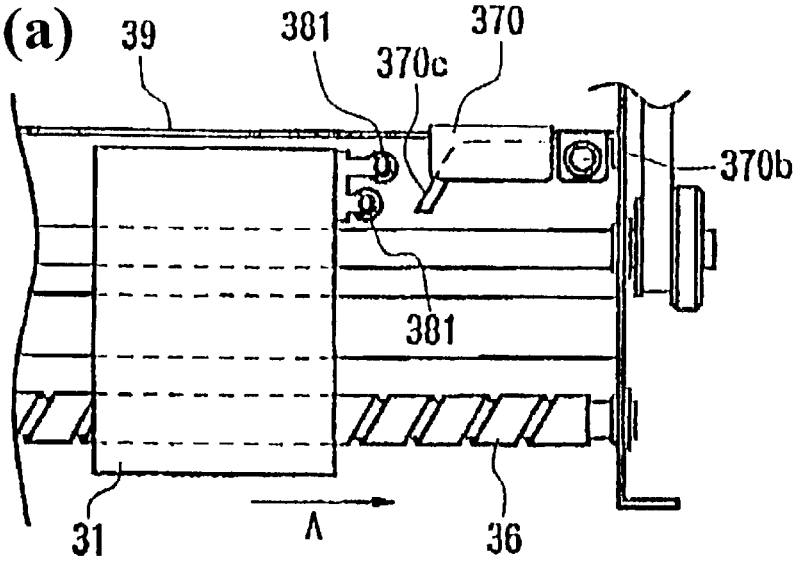
FIGS. 19(*a*) through 19(*c*) show a retracting operation of the preguide in FIG. 18 when the saddle-stitching unit moves.
Figure 19B:
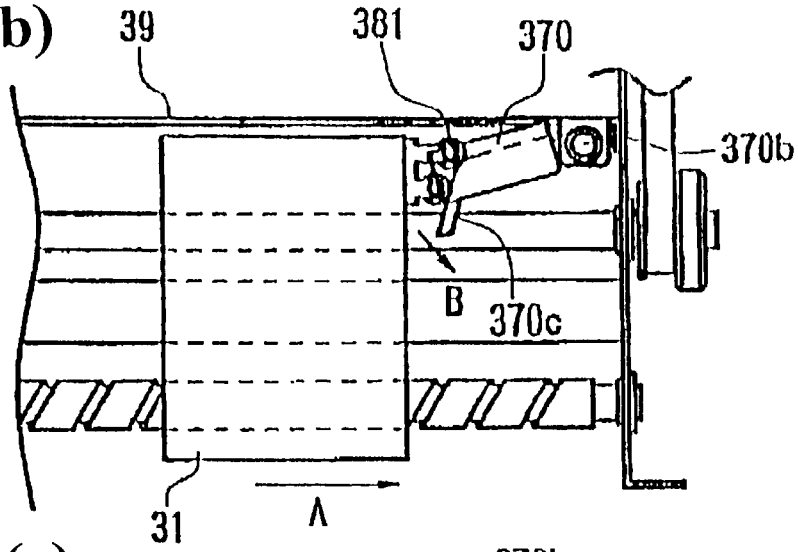
Figure 19C:
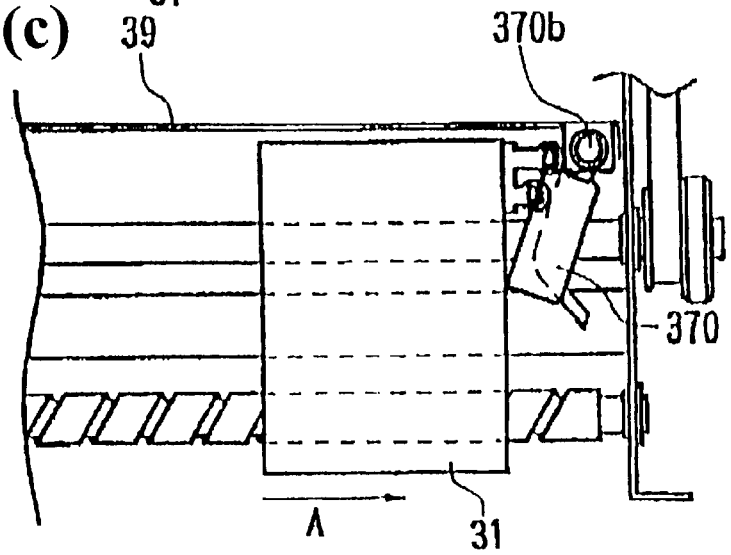
Figure 20:
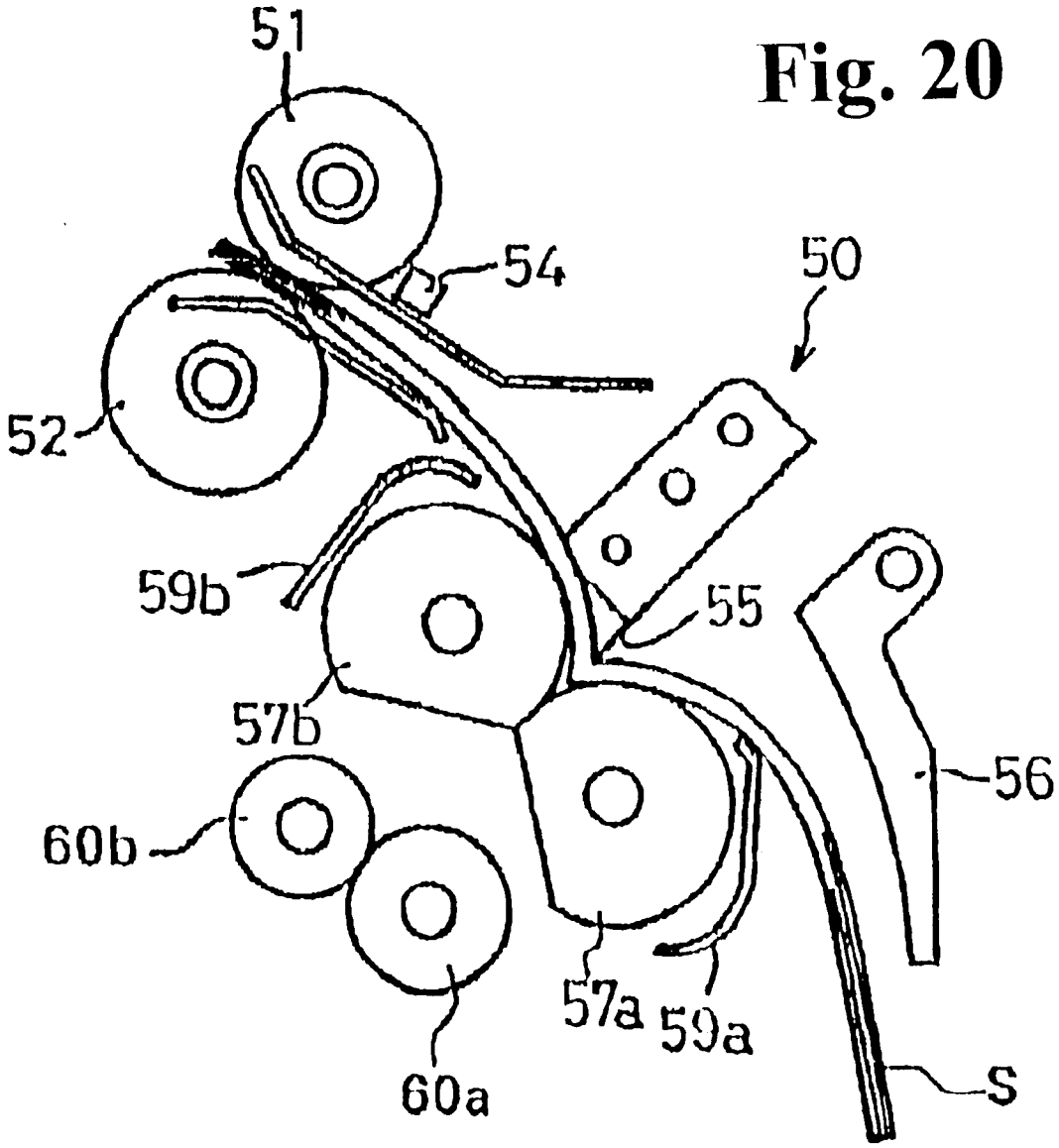
FIG. 20 is showing a sheet bundle folding operation of a folding unit disposed in the sheet processing apparatus in FIG. 1.

According to the preferred embodiment of the present invention, the preguide 370 is disposed to one side of the feed guide 39 in the upstream direction of sheet transport via the turning shaft 370*b*, as can be seen in FIGS. 19(*a*) to (*c*). When the staple-driving unit 31 moves in a width direction of the sheets, the preguide 370 is pressed by the staple-driving unit 31 and rotates around the turning shaft 370*b*. As a result, the preguide 370 retracts to a position where it does not interfere a movement of the staple-driving unit 31.

Also, the preguide 370 is urged by a spring (not shown) in the protruding direction to guide the sheet bundle above the feed guide 39, so that the leading edge of the sheet bundle does not touch a upstream edge of the feed guide 39. The preguide 370 protrudes above the feed guide 39 when not being pressed by the staple-driving unit 31.

According to the preferred embodiment of the present invention, an inclined contact portion 370*c* is attached to the preguide 370. The staple-driving unit 31 presses the inclined contact portion 370*c* when the staple-driving unit 31 moves in a sheet width direction, and the preguide 370 can smoothly move (rotate) to the retracted position.

Figure 18:
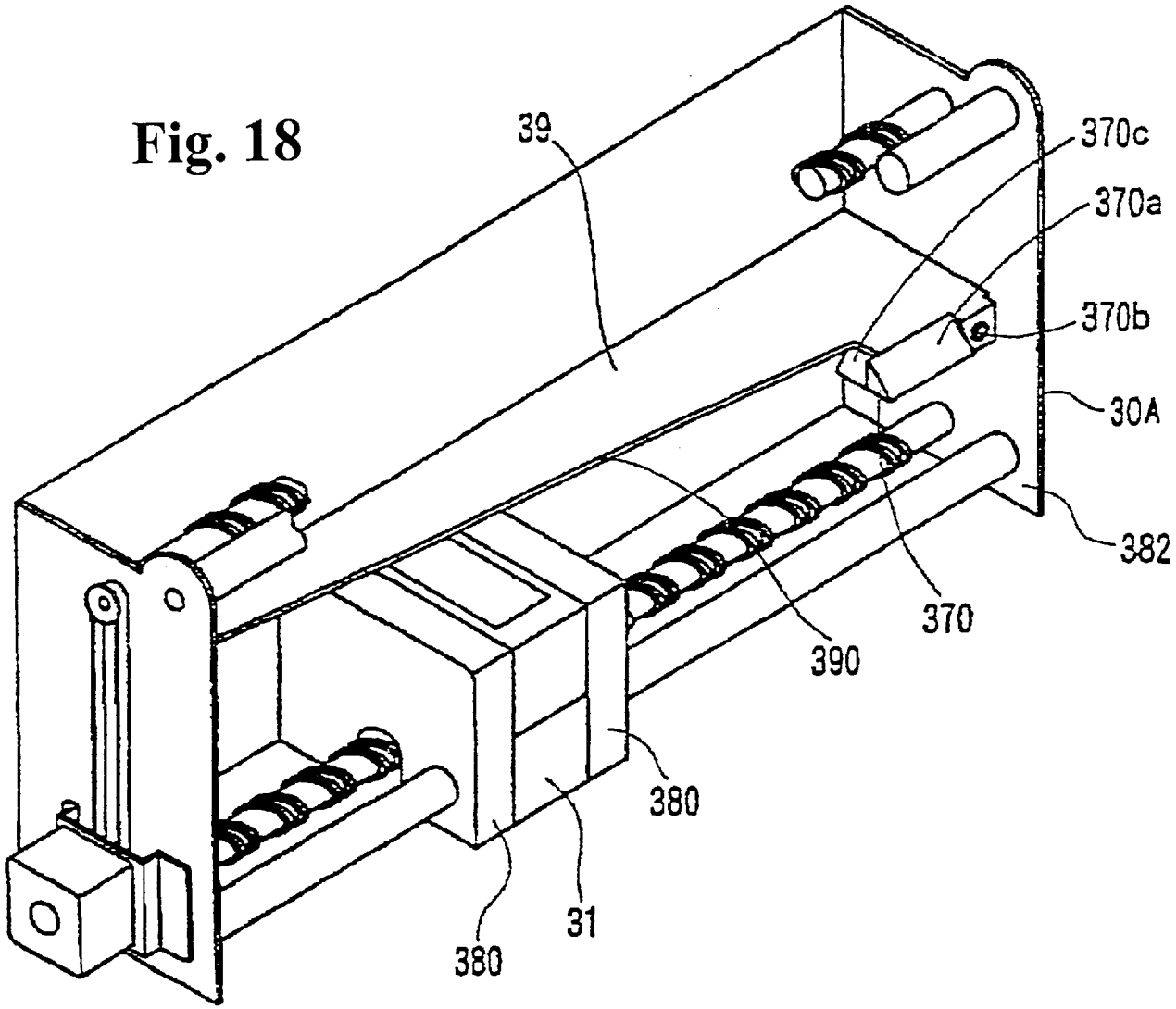
FIG. 18 is a perspective view of a preguide disposed in a transport guide.

Also, two pairs of rollers 381 are disposed on the cover 380 of the staple-driving unit 31 at a position facing the preguide 370 (see FIG. 18). The rollers 381 touch the contact portion 370*c* to assist the retracting movement of the preguide 370 when the staple-driving head moves.

As can be seen in FIG. 19(*a*), the staple-driving unit 31 moves in the direction of the arrow A. Then, when the staple-driving unit 31 presses against the contact portion 370*c* with the roller 381, the preguide 370 rotates around the turning shaft 370*b* in the direction of the arrow B as can be seen in FIG. 19(*b*), thereby being moved to the retract position, as can be seen in FIG. 19(*c*).

Through the rotational movement of the preguide 370 to the retracted position by the staple-driving unit 31, the staple-driving head 31 can be moved without being hindered by the preguide 370, thereby securing a wide space for stitching of the staple-driving unit 31. Also, the staple-driving unit can be moved to a side direction for easier access to replace staples.

In the embodiment, the preguide 370 is disposed to the feed guide 39 to move separately, but it is also acceptable to dispose the preguide 370 to the staple-driving head unit 31 so that the preguide 370 can move together with the staple-driving head unit 31.

In the case that the preguide 370 is disposed to the staple-driving head unit 31, when the sheet bundle aligned by the aligning plates 9 with reference to a center in the width direction is transported to the feed guide 39, the preguide 370 moves to a center in the width direction along with the staple-driving unit 31, or its proximity, for example, to a stitching position. This allows the sheet bundle to be balanced and guided to the feed guide 39.

In case, the sheet bundle, which is aligned on the base of either side of the edges in the width direction by the aligning plate 9, is transferred to the feed guide 39, the center of the sheet changes depending of the sheet size. However, the control block 149 as control means can control the stapler slide motor 42 on the basis of at least one of the aligning reference and the sheet size data, so that the preguide 370 is moved to the center position in the width direction or to the position close thereto depending on size of the sheet together with the staple driving head unit 31. With such a control, the sheet bundle can be guided into the feed guide 39 in good balance.

As the preguide 370 is disposed to the staple-driving unit 31, the preguide 370, moving together with the staple-driving unit 31, touches the side plate 382 on the lower case 30A (see FIG. 18) when the staple-driving unit 31 moves close to the side of the feed guide 39 to staple the sheet bundle, thereafter moving to the retracting position along the side plate 382.

Since the preguide 370 moves to the retracting position, the staple-driving unit 31 is able to move freely without the hindrance of the preguide 370. Note that by disposing the roller 381 to the side plate 382 on the lower case 30A, as shown in the FIGS. 19(*a*) to (*c*), the preguide 370 is able to move securely to the retracting position.

In the embodiment, the preguide 370 is disposed on the staple driving head unit 31 side viewed from the sheet bundle since a leading edge of the sheet bundle curled on the side of the staple driving head unit 31 arranged on a printing side of the sheets tends to be caught by the upstream edge of the feed guide 39 as curling occurs usually on the leading edge of the sheets.

The invention is not limited to the embodiment mentioned above, and alternatively the feed guide may be attached to the anvil unit 32. If the feed guide may be attached to the anvil unit 32, the preguide 370 may be placed on the side of the anvil unit 32 as viewed from the sheet bundle, for example, on an additional side cover (not shown) fixed to the anvil unit 32.

It should be noted that the feed guide 39 has a cutout portion 390 that is slanted on the upstream edge thereof from the center portion toward the edge in the sheet feed direction as shown in FIG. 18. With the slanted cutout portion 390, the edges of the sheet bundle can be smoothly guided to a guide surface on the feed guide 39.

When the sheet bundle has been fed to the stitching position, the leading edge of the sheet bundle in the feed direction already passes an area between the lower bundle feed roller 52 in the folding unit 50 and the upper stack feed roller 51 separated from the lower bundle feed roller 52.

After the stitching is completed, the sheet bundle is fed to come to an approximate center in the feed direction, that is, to bring the stitched position to become the folding position. The staple/folding motor 170 then is driven in a reverse direction of the stitching process. The pair of folding rollers 57*a* and 57*b* is rotated in the directions of nipping the sheet bundle S, and the abutting plate 55 is moved down as shown in FIG. 22. At the same time, the backup guides 59*a* and 59*b* move to free the paired folding rollers circumferences at the sheet bundle side.

After the abutting plate 55 has moved the rotating paired folding rollers 57*a* and 57*b* having the sheet bundle nipped therebetween, the sheet bundle S is rolled in between the paired folding rollers 57*a* and 57*b*. After that, while the abutting plate 55 moves in the direction separating from the sheet bundle, the sheet bundle is further folded by the paired folding rollers 57*a* and 57*b*.

At this point, the bundle feed upper roller 51, bundle feed lower roller 52 and the paired bundle feed rollers 60*a* and 60*b* are rotated in the direction to discharge the sheet bundle to the stack loading tray by the feed motor 162. The paired folding rollers 57*a* and 57*b*, on the other hand, are stopped when the abutting plate 55 moves up and is detected by the abutting plate HP sensor (not shown).

The sheet bundle S nipped and fed by the paired stack discharge rollers 60*a* and 60*b* is discharged to and stacked on the sheet bundle stacking tray 80. The folded sheet bundle is held down by the folded sheet holder 81 so that it does not open, thereby not preventing a subsequent folded sheet bundle from being fed in.

It should be noted that the upper stack feed roller 51 separates from the lower bundle feed roller 52, moves up, and prepares to feed in the next sheet bundle when a period of time available for the paired stack discharge rollers 60*a* and 60*b* to deliver the sheet bundle has elapsed.

In the saddle stitch mode in the embodiment described above, the stitching process and the folding process are consecutive. It should be known that only the folding process can be performed without the stitching process. Furthermore, the folded sheet bundle device can stack thereon only the sheet bundles folded but not stitched.

As described in detail above, the supplement guide member is disposed on an upstream of the guide member guiding the sheet bundle to the stitching position in the sheet bundle transport direction. Such a feature is effective that when the sheet bundle is fed to the stitching position, the sheet bundle can be led to the guide member without the leading edge of the sheet bundle touching an upstream of the guide member in the sheet bundle transport direction. This assures of secure feed of the sheet bundle and correct stitching.

Furthermore, when the stitching unit moves, the supplement guide member is retracted to a position that does not interfere with the movement of the stitching unit. Along with the movement thereof, this configuration allows a wide area for the stitching unit to stitch, without hindrance by the supplement guide member. Also, this enables the stitching unit to be moved to a side direction where it is easier to access and to replace staples.

While the invention has been explained with reference to the specific embodiments of the invention, the explanation is illustrative and the invention is limited only by the appended claims.

What is claimed is:

1. A sheet processing apparatus for processing a sheet bundle, comprising:

a stitching unit including a head portion for driving staples into the sheet bundle, and an anvil portion for receiving and bending said staples driven by the head portion and facing said head portion;

feeding means for feeding the sheet bundle to a stitching position between the head portion and the anvil portion in the stitching unit;

transport means attached to the stitching unit for transporting the same to a position perpendicular to a sheet bundle feeding direction;

a guide member disposed between the head portion and the anvil portion for guiding the sheet bundle to the stitching position; and a supplement guide member disposed at an upstream side of the guide member in the sheet bundle feeding direction, said supplement guide member being able to retract to a position that does not hinder movement of the stitching unit when the stitching unit moves, and guiding the sheet bundle to the guide member without a leading edge of the sheet bundle touching an upstream edge of the guide member in the sheet bundle feeding direction when the sheet bundle is fed to the stitching position.

2. A sheet processing apparatus for processing a sheet bundle according to claim 1, wherein said supplement guide member has an inclined contact portion abutting against the stitching unit so that the supplement guide member retracts when the stitching unit moves.

3. A sheet processing apparatus for processing a sheet bundle according to claim 2, wherein said stitching unit has a roller abutting against said contact portion.

4. A sheet processing apparatus for processing a sheet bundle according to claim 1, wherein said supplement guide member is disposed on the stitching unit so that when the stitching unit moves to a predetermined position, the supplement guide member retracts to a position that does not interfere with a movement of the stitching unit.

5. A sheet processing apparatus for processing a sheet bundle according to claim 1, further comprising:

aligning means situated adjacent to the stitching unit for aligning a side of the sheet bundle perpendicular to the sheet bundle feeding direction; and control means connected to the transport means for controlling the same so that a position of the supplement guide member is changed based on at least one of an aligning reference of said aligning means and a sheet size.

6. An image forming apparatus comprising:

an image forming unit; and a sheet processing apparatus attached to the image forming unit for processing a sheet bundle having sheets with images formed by the image forming unit, said sheet processing apparatus being formed according to claim 1.

* * * * *